US010621994B2

(12) United States Patent
Hatanaka et al.

(10) Patent No.: US 10,621,994 B2
(45) Date of Patent: Apr. 14, 2020

(54) AUDIO SIGNAL PROCESSING DEVICE AND METHOD, ENCODING DEVICE AND METHOD, AND PROGRAM

(71) Applicant: Sony Corporation, Tokyo (JP)

(72) Inventors: Mitsuyuki Hatanaka, Kanagawa (JP); Toru Chinen, Kanagawa (JP); Minoru Tsuji, Chiba (JP); Hiroyuki Honma, Chiba (JP)

(73) Assignee: Sony Corporaiton, Tokyo (JP)

( * ) Notice: Subject to any disclaimer, the term of this patent is extended or adjusted under 35 U.S.C. 154(b) by 109 days.

(21) Appl. No.: 15/314,263

(22) PCT Filed: May 22, 2015

(86) PCT No.: PCT/JP2015/064677
§ 371 (c)(1),
(2) Date: Nov. 28, 2016

(87) PCT Pub. No.: WO2015/186535
PCT Pub. Date: Dec. 10, 2015

(65) Prior Publication Data

US 2017/0194009 A1 Jul. 6, 2017

(30) Foreign Application Priority Data

Jun. 6, 2014 (JP) ..... 2014-117331

(51) Int. Cl.
*G10L 19/008* (2013.01)
*H04S 7/00* (2006.01)
(Continued)

(52) U.S. Cl.
CPC ..... *G10L 19/008* (2013.01); *G10L 19/032* (2013.01); *H04R 5/00* (2013.01);
(Continued)

(58) Field of Classification Search
CPC combination set(s) only.
See application file for complete search history.

(56) References Cited

U.S. PATENT DOCUMENTS

2004/0071059 A1* 4/2004 Kikuchi ..... H04R 5/04 369/47.23
2004/0096065 A1* 5/2004 Vaudrey ..... H04R 3/005 381/22

(Continued)

FOREIGN PATENT DOCUMENTS

JP 2009-522610 A 6/2009
JP 2010-136236 A 6/2010

(Continued)

OTHER PUBLICATIONS

[No Author Listed], Information technology—Coding of audio-visual objects—Part 3: Audio. ISO/IEC 14496-3; Fourth edition Sep. 1, 2009. 18 Pages.

(Continued)

*Primary Examiner* — Duc Nguyen
*Assistant Examiner* — Assad Mohammed
(74) *Attorney, Agent, or Firm* — Wolf, Greenfield & Sacks, P.C.

(57) ABSTRACT

The present technology relates to an audio signal processing device and method, an encoding device and method, and a program, which are capable of obtaining a higher quality sound. A selection unit selects, from supplied multichannel audio signals, audio signals of a channel of a dialogue sound and audio signals of a channel to be downmixed. A downmixing unit downmixes the audio signals of the channel to be downmixed. An addition unit adds the audio signals of the channel of a dialogue sound to audio signals of a predetermined channel among audio signals of one or more (Continued)

channels obtained in the downmixing. The present technology can be applied to a decoder.

8 Claims, 14 Drawing Sheets

(51) Int. Cl.
*G10L 19/032* (2013.01)
*H04R 5/00* (2006.01)
*H04S 3/00* (2006.01)
*H04S 3/02* (2006.01)

(52) U.S. Cl.
CPC ..... *H04S 3/008* (2013.01); *H04S 3/02* (2013.01); *H04S 7/30* (2013.01); *H04S 2400/01* (2013.01); *H04S 2400/03* (2013.01); *H04S 2400/09* (2013.01); *H04S 2400/13* (2013.01); *H04S 2420/03* (2013.01)

(56) References Cited

U.S. PATENT DOCUMENTS

2007/0280485 A1* 12/2007 Villemoes ..... H04S 7/307 381/22
2007/0297519 A1* 12/2007 Thompson ..... G10L 19/008 375/241
2009/0129601 A1 5/2009 Ojala et al.
2009/0164227 A1* 6/2009 Oh ..... G10L 19/008 704/500
2009/0245539 A1* 10/2009 Vaudrey ..... H03G 7/002 381/109
2010/0106507 A1* 4/2010 Muesch ..... H04R 25/356 704/270.1
2011/0246139 A1 10/2011 Kishi et al.
2013/0202024 A1* 8/2013 Suzuki ..... G10L 19/008 375/240.01
2013/0230177 A1 9/2013 Wilson et al.

FOREIGN PATENT DOCUMENTS

JP 2011-209588 A 10/2011
JP 2013-546021 A 12/2013

OTHER PUBLICATIONS

Written Opinion and English translation thereof dated Jun. 30, 2015 in connection with International Application No. PCT/JP2015/064677.
International Preliminary Report on Patentability and English translation thereof dated Dec. 15, 2016 in connection with International Application No. PCT/JP2015/064677.

* cited by examiner

FIG. 2

| | |
|---|---|
| dialog_channel_information() { | |
| ext_diag_status; | 1 bslfb |
| if (ext_diag_status == 1) { | |
| chans = get_main_audio_chans(); | |
| init_data(chans); | |
| ptr_bits = ceil(log(chans+1)/log (2)); | |
| for(i = 0; i < chans; i++){ | |
| diag_present_flag[i]; | 1 bslfb |
| if(diag_present_flag[i] ==1){ | |
| diag_tag_idx[i]; | ptr_bits bslfb |
| num_of_dest_chans5[i]; | 3 bslfb |
| for(j =1; j <= num_of_dest_chans5[i];j++){ | |
| diag_dest5[i][j-1]; | 3 bslfb |
| diag_mix_gain5[i][j-1]; | 3 bslfb |
| } | |
| num_of_dest_chans2[i]; | 2 bslfb |
| for(j =1; j <= num_of_dest_chans2[i];j++){ | |
| diag_dest2[i][j-1]; | 1 bslfb |
| diag_mix_gain2[i][j-1]; | 3 bslfb |
| } | |
| num_of_dest_chans1[i]; | 1 bslfb |
| if(num_of_dest_chans1[i] == 1){ | |
| diag_mix_gain1[i]; | 3 bslfb |
| } | |
| } | |
| } | |
| byte_alignment(); | |
| }else{ | |
| reserved, set to "0000000" | 7 bslfb |
| } | |
| } | |

FIG. 3

| ENCODE MODE | CORRESPONDENCE BETWEEN ELEMENTS OF diag_present_flag[] AND SPEAKERS<br>CORRESPONDENCE BETWEEN DOWNMIXING DESTINATIONS diag_dest5 OR diag_dest2 AND SPEAKERS |
|---|---|
| 1ch MONAURAL | 0 : FC |
| 2ch STEREO | 0 : FL<br>1 : FR |
| 5. 1ch | 0 : FC<br>1 : FL<br>2 : FR<br>3 : LS<br>4 : RS |
| 6. 1ch | 0 : FC<br>1 : FL<br>2 : FR<br>3 : BL<br>4 : BR<br>5 : BC |
| 7. 1ch | 0 : FC<br>1 : FL<br>2 : FR<br>3 : LS<br>4 : RS<br>5 : TpFL<br>6 : TpFR |

| ENCODE MODE | CORRESPONDENCE BETWEEN ELEMENTS OF diag_present_flag[] AND SPEAKERS<br>CORRESPONDENCE BETWEEN DOWNMIXING DESTINATIONS diag_dest5 OR diag_dest2 AND SPEAKERS |
|---|---|
| 22. 2ch | 0 : FC<br>1 : FLc<br>2 : FRc<br>3 : FL<br>4 : FR<br>5 : SiL<br>6 : SiR<br>7 : BL<br>8 : BR<br>9 : BC<br>10 : TpFC<br>11 : TpFL<br>12 : TpFR<br>13 : TpSiL<br>14 : TpSiR<br>15 : TpC<br>16 : TpBL<br>17 : TpBR<br>18 : TpBC<br>19 : BtFC<br>20 : BtFL<br>21 : BtFR |

FIG. 4

| diag_mix_gain5<br>diag_mix_gain2<br>diag_mix_gain1 | GAIN FACTOR VALUE<br>fac |
|---|---|
| 000 | 1.0 (0dB) |
| 001 | 0.841 (-1.5dB) |
| 010 | 0.707 (-3dB) |
| 011 | 0.596 (-4.5dB) |
| 100 | 0.500 (-6dB) |
| 101 | 0.422 (-7.5dB) |
| 110 | 0.355 (-9dB) |
| 111 | 0.000 (-∞dB) |

| | 1frame | 2frame | 3frame | 4frame | 5frame | 6frame |
|---|---|---|---|---|---|---|
| FC | 1 | 1 | 1 | 1 | 1 | 1 |
| FL | 0 | 0 | 0 | 0 | 0 | 0 |
| FR | 0 | 0 | 0 | 0 | 0 | 0 |
| LS | 1 | 1 | 1 | 1 | 1 | 1 |
| RS | 0 | 0 | 0 | 0 | 0 | 0 |
| TpFL | 0 | 0 | 0 | 0 | 0 | 0 |
| TpFR | 0 | 0 | 0 | 0 | 0 | 0 |

AUDIO SIGNAL PROCESSING DEVICE AND METHOD, ENCODING DEVICE AND METHOD, AND PROGRAM

CROSS-REFERENCE TO RELATED APPLICATIONS

This application is a National Stage of International Application No. PCT/JP2015/064677, filed in the Japanese Patent Office as a Receiving office on May 22, 2015, which claims priority to Japanese Patent Application Number 2014-117331, filed in the Japanese Patent Office on Jun. 6, 2014, each of which is hereby incorporated by reference in its entirety.

TECHNICAL FIELD

The present technology relates to an audio signal processing device and method, an encoding device and method, and a program, and more particularly, an audio signal processing device and method, an encoding device and method, and a program that are capable of obtaining a higher quality sound.

BACKGROUND ART

Conventionally, regarding an audio reproduction of multichannel data, when the actual reproduction environment is not equal to or better than the reproduction environment required by the original content, generally, a method of executing a downmixing process to convert the signals to audio signals in fewer channels to reproduce is employed (for example, see Non-Patent Document 1).

CITATION LIST

Non-Patent Document

Non-Patent Document 1: ISO/IEC 14496-3:2009/AMD 4:2013 Information technology-Coding of audio-visual objects-Part 3: Audio

SUMMARY OF THE INVENTION

Problems to be Solved by the Invention

Such multichannel data sometimes includes a channel which is dominant and quite meaningful over other background sounds, such as a dialogue sound, which is a sound mainly composed of human voice, and the signals of the channel of a dialogue sound are distributed to some channels after downmixing in a downmixing process. Further, by a gain suppression correction to suppress a clip caused in an addition of signals of plural channels in a downmixing process, a gain of the signals of each channel before adding is made small.

Because of the above reasons, a sound image localization of the dialogue sound after the downmixing process becomes unclear or a sound reproduction volume of the dialogue sound is reduced, and this makes the dialogue sound indiscernible.

As described above, according to the above technology, when an audio reproduction, especially a downmixing process, of multichannel data is executed, the dialogue sound becomes unclear and the quality of the reproduced sound is deteriorated.

The present technology has been made in the view of such a situation and is capable of obtaining a higher quality sound.

Solutions to Problems

An audio signal processing device according to a first aspect of the present technology includes: a selection unit configured to select, from multichannel audio signals, audio signals of a channel of a dialogue sound and audio signals of plural channels to be downmixed, on the basis of information related to each channel of the multichannel audio signals; a downmixing unit configured to downmix the audio signals of the plural channels to be downmixed into audio signals of one or more channels; and an addition unit configured to add the audio signals of the channel of a dialogue sound to audio channels of a predetermined channel among the one or more channels obtained by the downmixing.

The addition unit may be made to add the audio signals of the channel of a dialogue sound to the predetermined channel that is a channel specified by addition destination information indicating a destination to add the audio signals of the channel of a dialogue sound.

There may be further included a gain correction unit configured to perform a gain correction on the audio signals of the channel of a dialogue sound on the basis of gain information indicating a gain of the audio signals of the channel of dialogue sound at a timing of addition to the audio signals of the predetermined channel. The addition unit may be made to add the audio signals, in which the gain correction is performed by the gain correction unit, to the audio signals of the predetermined channel.

The audio signal processing device may further include an extraction unit configured to extract, from the bit stream, the information related to each channel, the addition destination information, and the gain information.

The extraction unit may be made to further extract the encoded multichannel audio signals from the bit stream, and there may be further included a decoding unit configured to decode the encoded multichannel audio signals and output the signals to the selection unit.

The downmixing unit may be made to perform multiple-stage downmixing on the audios signals of the plural channels to be downmixed, and the addition unit may be made to add the audio signals of the channel of a dialogue sound to the audio signals of the predetermined channel among the audio signals of the one or more channels obtained in the multiple-stage downmixing.

An audio signal processing method or a program according to the first aspect of the present technology includes the steps of: selecting, from multichannel audio signals, audio signals of a channel of a dialogue sound and audio signals of plural channels to be downmixed, on the basis of information related to each channel of the multichannel audio signals; downmixing the audio signals of the plural channels to be downmixed into audio signals of one or more channels; and adding the audio signals of the channel of a dialogue sound to audio signals of a predetermined channel among the audio signals of the one or more channels obtained in the downmixing.

According to the first aspect of the present technology, on the basis of information related to each channel of multichannel audio signals, audio signals of a channel of a dialogue sound and audio signals of plural channels to be downmixed are selected from the multichannel audio signals, the audio signals of the plural channels to be downmixed are downmixed into audio signals of one or more channels, and the audio signals of the channel of a dialogue sound are added to the audio signals of a predetermined channel among the audio signals of the one or more channels obtained in the downmixing.

An encoding device according to a second aspect of the present technology includes: an encoding unit configured to encode multichannel audio signals; a generation unit configured to generate identification information, which indicates whether or not each channel of the multichannel audio signals is a channel of a dialogue sound; and a packing unit configured to generate a bit stream including the encoded multichannel audio signals and the identification information.

The generation unit may be made to further generate addition destination information, which indicates a channel of audio signals as a destination to add the audio signals of the channel of a dialogue sound among the audio signals of one or more channels obtained in downmixing, when the multichannel audio signals are downmixed. The packing unit may be made to generate the bit stream including the encoded multichannel audio signals, the identification information, and the addition destination information.

The generation unit may be made to further generate gain information of the audio signals of the channel of a dialogue sound at a timing of addition to a channel indicated by the addition destination information. The packing unit may be made to generate the bit stream including the encoded multichannel audio signal, the identification information, the addition destination information, and the gain information.

An encoding method or a program according to the second aspect of the present technology includes the steps of:

encoding multichannel audio signals;

generating identification information, which indicates whether or not each channel of the multichannel audio signals is a channel of a dialogue sound, and generating a bit stream including the encoded multichannel audio signals and the identification information.

According to the second aspect of the present technology, multichannel audio signals are encoded, identification information, which indicates whether or not each channel of the multichannel audio signals is a channel of a dialogue sound is generated, and a bit stream including the encoded multichannel audio signal and the identification information is generated.

Effects of the Invention

According to the first and second aspects of the present technology, a higher quality sound can be obtained.

Here, the effects described here do not have to be limited and any one of the effects described in this specification may be provided.

BRIEF DESCRIPTION OF DRAWINGS

FIG. 2 is a diagram for explaining dialogue channel information.

FIG. 3 is a diagram for explaining mapping of each channel.

FIG. 4 is a diagram for explaining a gain factor.

MODE FOR CARRYING OUT THE INVENTION

Hereinafter, embodiments to which the present technology is applied will be described with reference to the drawings.

First Embodiment

<Outline of the Present Technology>

The present technology is helpful to prevent a dialogue sound from being unclear and obtain a higher quality sound by outputting audio signals of a channel including a dialogue sound in multichannel audio signals, from a channel which is separately specified, as excluding from the target of a downmixing process. Further, according to the present technology, dialogue sounds can be selectively reproduced by identifying a plurality of channels of dialogue sounds among multichannel audio signals including dialogue sounds.

Here, in this case, a case that the channel excluded from the target of a downmixing process is a channel of a dialogue sound will be explained as an example; however, it is not limited to the dialogue sound and a channel of other sounds which is dominant and quite meaningful over a background sound may be excluded from downmixing and added to a predetermined channel after downmixing. Further, in the following, a case that multichannel audio signals are encoded according to the standard of advanced audio coding (AAC); however, a similar process can be executed in a case of encoding in other systems.

For example, when multichannel audio signals are encoded according to the AAC standard and transmitted, the audio signals of each channel are encoded by each frame and transmitted.

Figure 1:
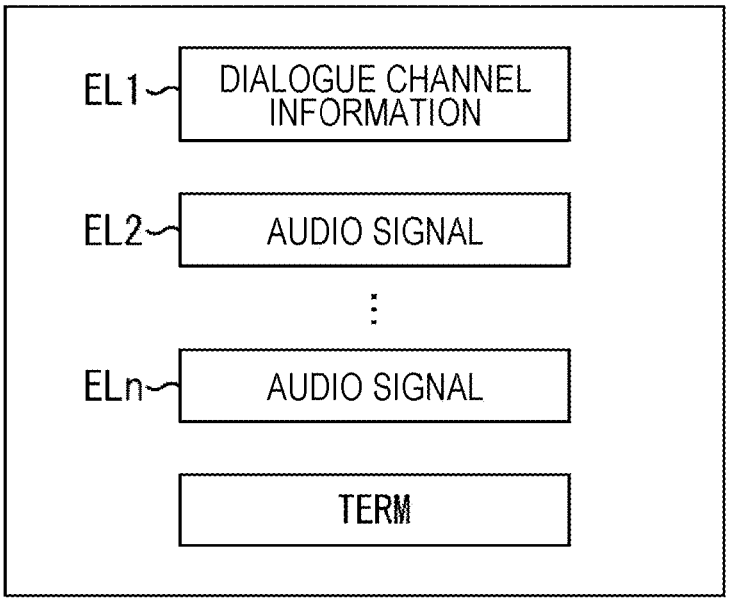
FIG. 1 is a diagram for explaining a bit stream.

Specifically, as illustrated in FIG. 1, encoded audio signals and information required to decode the audio signals are stored in a plurality of elements (bit stream elements) and a bit stream including those elements is transmitted.

In this example, in a bit stream for a single frame, n number of elements EL1 to ELn are disposed in order from the beginning and there is an identifier TERM at the end, which indicates an terminal position of the information in the frame.

For example, the element EL1 disposed at the beginning is an ancillary data area called a data stream element (DSE), and in the DSE, information of plural channels including information related to downmixing of audio signals, dialogue channel information related to a dialogue sound, and the like is written.

In the elements EL2 to ELn, which follow the element EL1, encoded audio signals are stored. More specifically, an element storing audio signals of a single channel is called SCE and an element storing audio signals of pared two channels is called CPE.

According to the present technology, when multichannel audio signals are downmixed, audio signals of a channel of a dialogue sound are not included in the target of the downmixing. Thus, according to the present technology, dialogue channel information is generated and stored in the DSE so that the channel of a dialogue sound can be easily specified in the bit stream reception side.

Syntax of such dialogue channel information is illustrated in FIG. 2 for example.

In FIG. 2, "ext_diag_status" is a flag indicating whether or not there is information related to a dialogue sound after this ext_diag_status. More specifically, when the value of ext_diag_status is "1," there is information related to a dialogue sound and, when the value of ext_diag_status is "0," there is no information related to a dialogue sound. When the value of ext_diag_status is "0," "0000000" is set after ext_diag_status.

Further, "get_main_audio_chans( )" is an auxiliary function to obtain a number of audio channels included in the bit stream and information for the respective channels obtained by calculation using this auxiliary function is stored after get_main_audio_chans( ).

Here, in the calculation using get_main_audio_chans( ) a number of channels excluding an LFE channel, that is, a number of main audio channels, is obtained as a calculation result. This is because that the dialogue channel information does not include information related to the LFE channel.

"init_data(chans)" is an auxiliary function to initialize various parameters related to the channel of a dialogue sound for the respective number of channels "chans" specified by arguments in an audio signal reproducing side, which is in a bit stream decoding side. More specifically, by computing the auxiliary function, the values of nine pieces of information in total including "diag_tag_idx[i]," "num_of_dest_chans5[i]," "diag_dest5[i][j−1]," "diag_mix_gain5[i][j−1]," "num_of_dest_chans2[i]," "diag_dest2[i][j−1]," "diag_mix_gain2[i][j−1]," "num_of_dest_chans1[i]," and "diag_mix_gain1[i]" are set to "0."

"ceil(log(chans+1)/log(2))" is an auxiliary function that returns, as an output, a smallest integer value which is larger than a fractional value given by the arguments, and, with the auxiliary function, a calculation is executed to obtain a number of bits required to express the property of the channel of a dialogue sound, that is, later described diag_tag_idx[i].

"diag_present_flag[i]" is identification information indicating whether or not a channel specified by an index i (here, $0 \leq i \leq chans-1$) of the plural channels included in the bit stream, that is, a channel of the channel number i, is a channel of a dialogue sound.

More specifically, when the value of diag_present_flag[i] is "1," this indicates that the channel of the channel number i is a channel of a dialogue sound and, when the value of diag_present_flag[i] is "0," this indicates that the channel of the channel number i is not a channel of a dialogue sound. Here, in this example, there are diag_present_flag[i] as many as the number of channels obtained with get_main_audio_chans ( ); however, a method for transmitting information of the number of dialogue sound channels and identification information showing speaker mapping in which the respective channels of dialogue sounds as many as the number of the channels of dialogue sounds are corresponded may be used.

Further, regarding the speaker mapping of audio channels, that is, the mapping of which channel numbers i is set as a channel corresponding to which speaker, for example, mapping that defines in each encode mode as illustrated in FIG. 3 is used.

In FIG. 3, the left part in the drawing illustrates the encode modes, that is, how many channels each speaker system has, and the right part in the drawing illustrates channel numbers applied to each channel of the corresponding encode mode.

Here, the mapping of the channel numbers and the channels corresponding to the speakers illustrated in FIG. 3 is not used only for multichannel audio signals stored in the bit stream but also used for downmixed audio signals in the bit stream reception side. In other words, the mapping illustrated in FIG. 3 illustrates a correspondence relationship between a channel number i, a channel number indicated by later described diag_dest5[i][j−1], or a channel number indicated by later described diag_dest2[i][j−1] with a channel corresponding to a speaker.

In an encode mode of 2 channel (stereo) for example, a channel number 0 represents an FL channel and a channel number 1 represents an FR channel.

Further, in an encode mode of a 5.1 channel for example, the channel numbers 0, 1, 2, 3, and 4 respectively represent an FC channel, an FL channel, an FR channel, an LS channel, and an RS channel.

Thus, for example, when the number of channels obtained by get_main_audio_chans( ), that is, the number of channels of the audio signals stored in the bit stream, is two channels, "channel number i=1" represents the FR channel. Hereinafter, the channel of the channel number i is also simply referred to as a channel i.

Back to the explanation of FIG. 2, regarding the channel i which is supposed to be a channel of a dialogue sound by diag_present_flag[i], after the diag_present_flag[i], nine pieces in total of information of "diag_tag_idx[i]," "num_of_dest_chans5[i]," "diag_dest5[i][j−1]," "diag_mix_gain5[i][j−1]," "num_of_dest_chans2[i]," "diag_dest2[i][j−1]," "diag_mix_gain2[i][j−1]," "num_of_dest_chans1[i]," and "diag_mix_gain1[i]" are stored.

"diag_tag_idx[i]" is information that identifies the property of the channel i. In other words, it represents which of the plurality of dialogue sounds the sound of the channel i is.

More specifically, for example, it represents the property such as whether the channel i is a channel of a Japanese sound or a channel of an English sound. Here, the property of the dialogue sound is not limited to languages and may be anything such as information that identifies the performer or information that identifies an object. According to the present technology, since the channel of each dialogue sound is identified by diag_tag_idx[i], for example, more flexible audio reproduction, such as a reproduction of audio signals of a channel of a dialogue sound having a particular property when reproducing an audio signal, can be realized.

"num_of_dest_chans5[i]" indicates a number of channels after downmixing to which the audio signals of the channel i are added, in a case that the audio signal is downmixed to 5.1 channel (hereinafter, also referred to as 5.1ch).

"diag_dest5[i][j−1]" stores channel information that indicates a channel to which the audio signal of the channel i of a dialogue sound are added, after downmixing to 5.1ch. For example, when diag_dest5[i][j−1] is =2, it is found that the FR channel after downmixing is the channel to which the audio signal of the channel i is added, on the basis of the mapping illustrated in FIG. 3.

"diag_mix_gain5[i][j−1]" stores an index that indicates a gain factor when the audio signals of the channel i are added to the channel identified (specified) by the information (channel number) stored in diag_dest5[i][j−1].

diag_dest5[i][j−1] and diag_mix_gain5[i][j−1] are stored in the dialogue channel information as many as indicated by num_of_dest_chans5[i]. Here, a variable j of the diag_dest5 [i][j−1] and diag_mix_gain5[i][j−1] is set as a value from one to num_of_dest_chans5[i].

The gain factor defined by the value of diag_mix_gain5 [i][j−1] is obtained by applying a function fac as illustrated in FIG. 4 for example. In other words, in FIG. 4, the left part in the drawing illustrates values of diag_mix_gain5[i][j−1] and the right part in the drawing illustrates gain factors (gain values) which are previously set to the value of diag_mix_gain5[i][j−1]. For example, when the value of diag_mix_gain5[i][j−1] is "000," the gain factor is set as "1.0" (0 dB).

Back to the explanation of FIG. 2, when the audio signal is downmixed to 2 channel (2ch), "num_of_dest_chans2[i]" indicates the number of channels after downmixing, to which the audio signals of the channel i are added.

"diag_dest2[i][j−1]" stores, after down mixing the signals to 2ch, channel information (channel number) that indicates a channel to which the audio signals of the channel i of dialogue sound are to be added. Further, the "diag_mix_gain2[i][j−1]" stores an index that indicates a gain factor when the audio signals of the channel i are added to the channel identified by the information stored in diag_dest2[i][j−1]. Here, the correspondence relationship between the value of diag_mix_gain2[i][j−1] and the gain factor is the relationship illustrated in FIG. 4.

Further, a pair of diag_dest2[i][j−1] and diag_mix_gain2 [i][j−1] are stored in the dialogue channel information as many as the number indicated in num_of_dest_chans2[i]. Here, the variables j in diag_dest2[i][j−1] and diag_mix_gain2[i][j−1] are set as a value from one to num_of_dest_chans2[i].

"num_of_dest_chans1[i]" indicates a number of channels after downmixing, to which the audio signals of the channel i are added when the audio signal is downmixed to a monaural channel, which is 1 channel (1ch). "diag_mix_gain1[i]" stores an index that indicates a gain factor when the audio signals of the channel i are added to the audio signal after downmixing. Here, the correspondence relationship between the values of diag_mix_gain1[i] and the gain factor is the relationship illustrated in FIG. 4.

<Configuration Example of Encoder>

Next, an embodiment of an encoder to which the present technology is applied will be explained.

Figure 5:
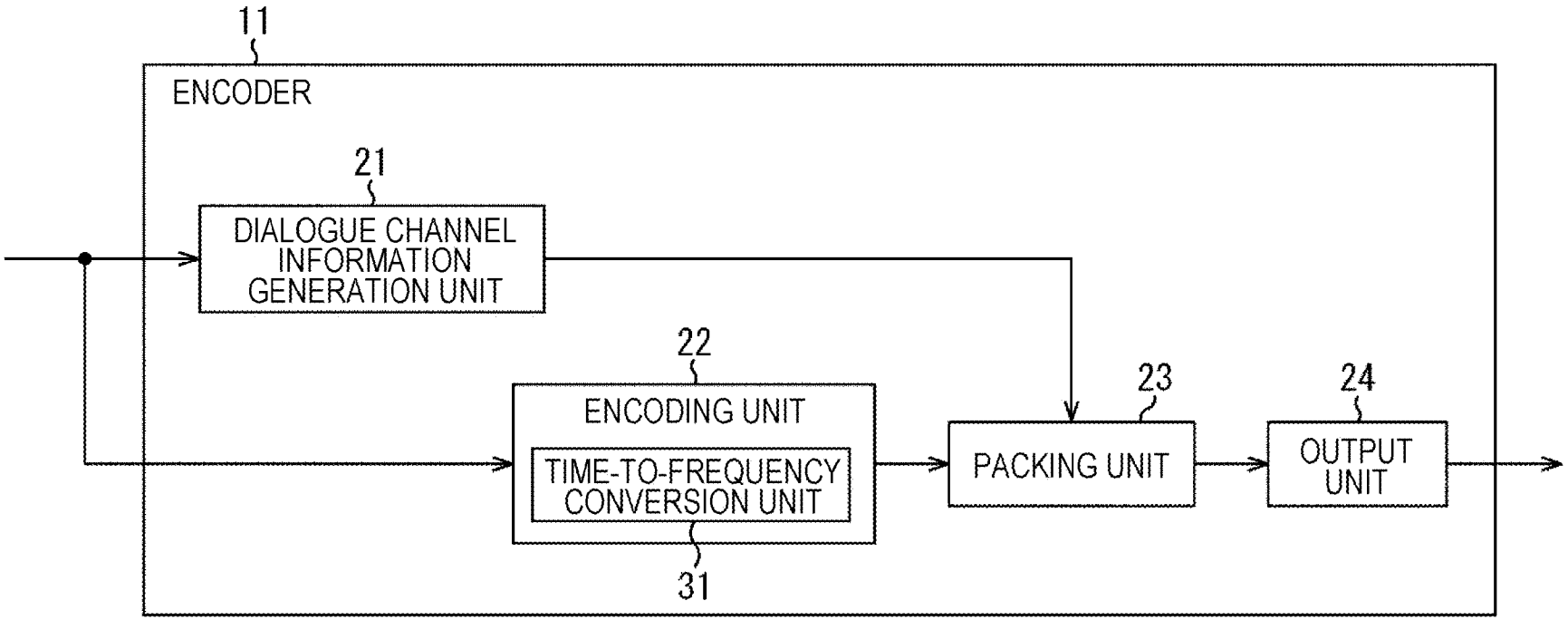
FIG. 5 is a diagram for explaining a configuration example of an encoder.

FIG. 5 is a diagram illustrating a configuration example of an encoder to which the present technology is applied.

An encoder 11 includes a dialogue channel information generation unit 21, an encoding unit 22, a packing unit 23, and an output unit 24.

The dialogue channel information generation unit 21 generates dialogue channel information on the basis of multichannel audio signals supplied from outside and various information related to a dialogue sound and supplies the dialogue channel information to the packing unit 23.

The encoding unit 22 encodes the multichannel audio signals supplied from outside and supplies the encoded audio signals (hereinafter, also referred to as encoded data) to the packing unit 23. Further, the encoding unit 22 includes a time-to-frequency conversion unit 31 that performs a time-to-frequency conversion on the audio signals.

The packing unit 23 generates a bit stream by packing the dialogue channel information supplied from the dialogue channel information generation unit 21 and the encoded data supplied from the encoding unit 22 and supplies the bit stream to the output unit 24. The output unit 24 outputs the bit stream supplied from the packing unit 23 to a decoder.

<Explanation of Encoding Process>

Next, an operation of the encoder 11 will be explained.

Figure 6:
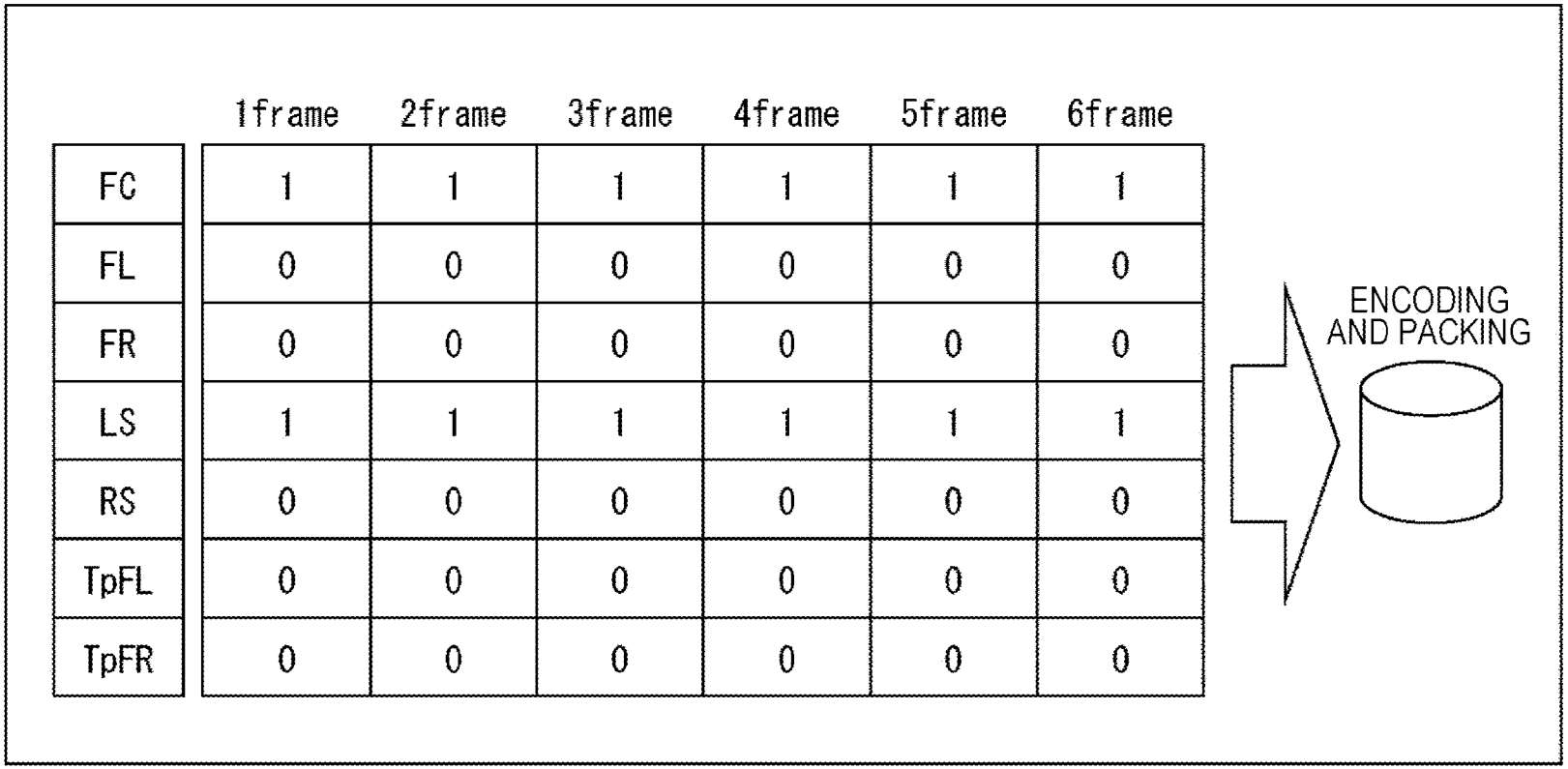
FIG. 6 is a diagram for explaining encoding of dialogue channel information.

When multichannel audio signals are supplied from outside, the encoder 11 encodes each frame of the audio signals and outputs the bit stream. In this case, for example, as illustrated in FIG. 6, regarding each channel composing the multichannel, diag_present_flag [i] is generated as identification information of the channels of dialogue sounds for each frame and encoded.

In this example, FC, FL, FR, LS, RS, TpFL, and TpFR respectively represent the FC channel, FL channel, FR channel, LS channel, RS channel, TpFL channel, and TpFR channel that compose 7.1ch and identification information is generated for the respective channels.

In this case, each rectangle represents identification information of each channel of each frame and the numerical values of "1" or "0" in those rectangles indicate values of the identification information. Thus, in this example, it can be seen that the FC channel and LS channel are channels of dialogue sounds and other channels are channels without a dialogue sound.

The encoder 11 generates, for each frame of the audio signal, dialogue channel information including identification information of each channel and outputs a bit stream including the dialogue channel information and encoded data.

Figure 7:
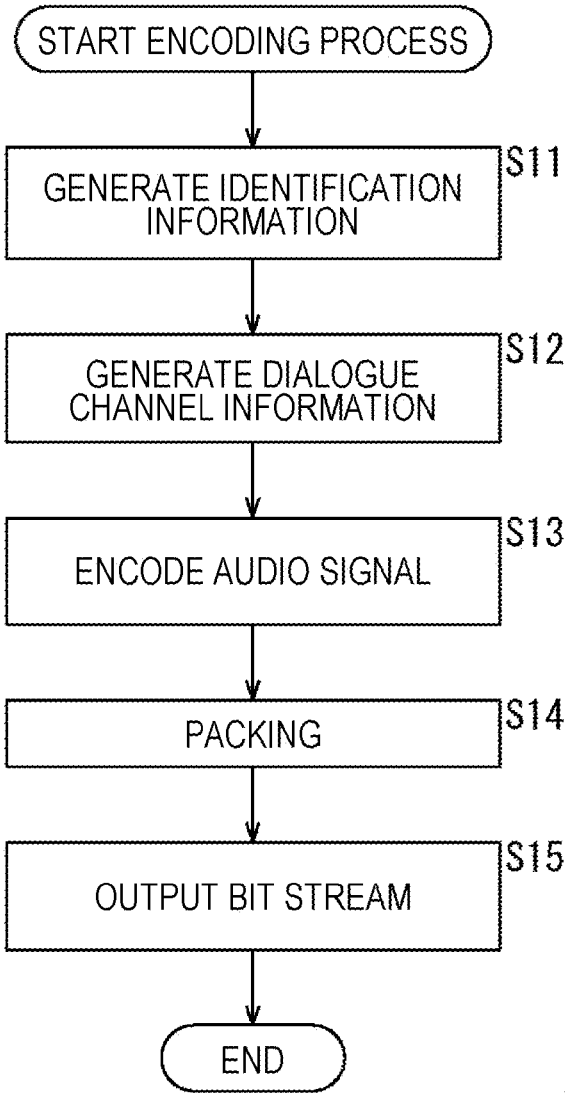
FIG. 7 is a flowchart for explaining an encoding process.

Hereinafter, with reference to the flowchart of FIG. 7, an encoding process in which the encoder 11 encodes the audio signals and outputs a bit stream will be explained. Here, this encoding process is performed for each frame of the audio signals.

In step S11, the dialogue channel information generation unit 21 determines whether or not each channel composing the multichannel is a channel of a dialogue sound on the basis of the multichannel audio signals supplied from outside, and generates identification information on the basis of the determination result.

For example, the dialogue channel information generation unit 21 extracts a feature amount from pulse code modulation (PCM) data supplied as audio signals of a predetermined channel, and determines whether the audio signals of the channel are dialogue sound signals on the basis of the feature amount. Then, the dialogue channel information generation unit 21 generates identification information on the basis of the determination result. With this configuration, diag_present_flag[i] illustrated in FIG. 2 is obtained as identification information.

Here, information that indicates whether each channel is a channel of a dialogue sound may be supplied from outside to the dialogue channel information generation unit 21.

In step S12, the dialogue channel information generation unit 21 generates dialogue channel information on the basis of information related to the dialogue sound supplied from outside and the identification information generated in step S11 and supplies the dialogue channel information to the packing unit 23. In other words, the dialogue channel information generation unit 21 generates diag_dest5[i][j−1], which is information indicating a destination to add the channel of a dialogue sound, or diag_mix_gain5 [i][j−1], which is gain information indicating a gain when adding the channel of a dialogue sound on the basis of the information related to the dialogue sound supplied form outside. Then, the dialogue channel information generation unit 21 obtains dialogue channel information by encoding those information and identification information. With this configuration, for example, the dialogue channel information illustrated in FIG. 2 is obtained.

In step S13, the encoding unit 22 encodes the multichannel audio signals supplied from outside.

More specifically, the time-to-frequency conversion unit 31 performs a modified discrete cosine transform (MDCT) on the audio signals and converts the audio signals from time signals to frequency signals.

Further, the encoding unit 22 encodes an MDCT coefficient obtained from the MDCT for the audio signals and obtains a scale factor, side information, and a quantum spectrum. Then, the encoding unit 22 supplies the obtained scale factor, side information, and quantum spectrum to the packing unit 23 as encoded data which is obtained by encoding the audio signal.

In step S14, the packing unit 23 generates a bit stream by packing the dialogue channel information supplied from the dialogue channel information generation unit 21 and the encoded data supplied from the encoding unit 22.

In other words, regarding the frame to be processed, the packing unit 23 generates a bit stream composed of SCE and CPE in which the encoded data is stored and DSE including dialogue channel information or the like and supplies the bit stream to the output unit 24.

In step S15, the output unit 24 outputs the bit stream supplied from the packing unit 23 to the decoder and the encoding process ends. Then, after that, encoding of a following frame is performed.

As described above, when encoding the audio signal, the encoder 11 generates identification information on the basis of the audio signal, then generates dialogue channel information including the identification information, and stores the dialogue channel information in the bit stream. With this configuration, the reception side of the bit stream can specify the audio signals of which channel are audio signals of a dialogue sound. As a result, the audio signals of a dialogue sound can be excluded from the downmixing process and added to the signal after downmixing so that a high quality sound can be obtained.

<Configuration Example of Decoder>

Next, a decoder that receives the bit stream output from the encoder 11 and decodes audio signals will be explained.

Figure 8:
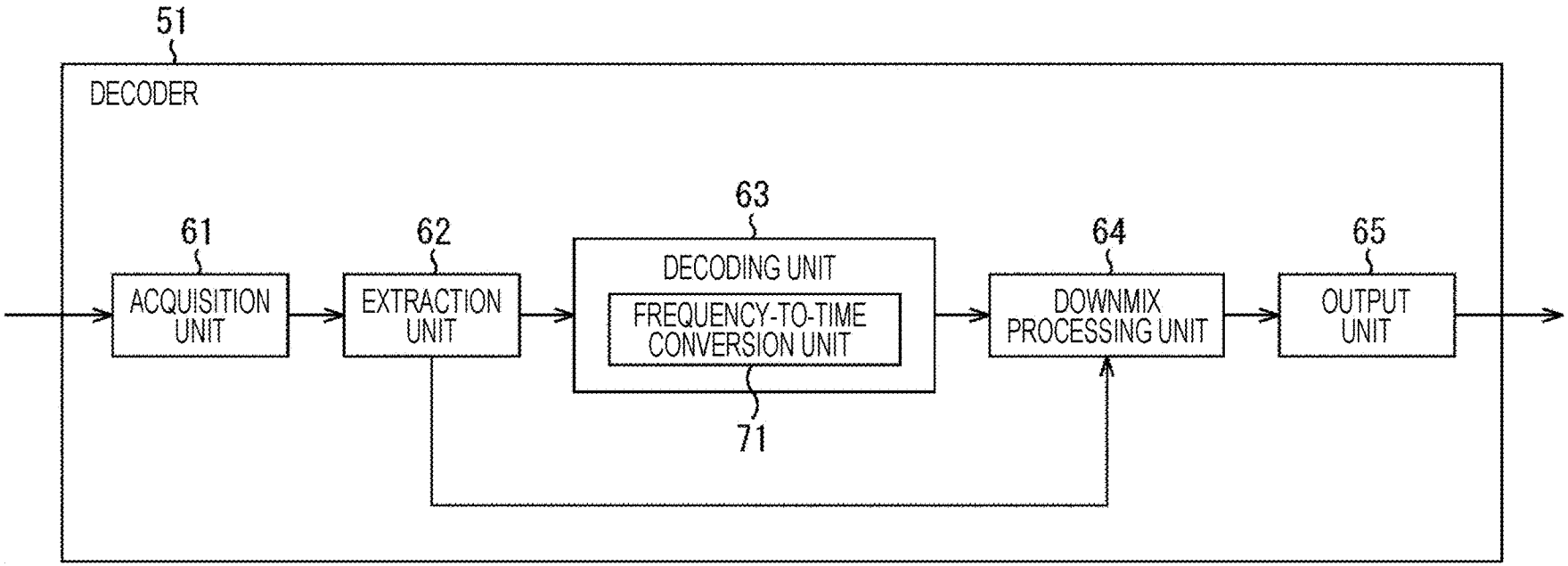
FIG. 8 is a diagram illustrating a configuration example of a decoder.

FIG. 8 is a diagram illustrating a configuration example of a decoder to which the present technology is applied.

A decoder 51 of FIG. 8 is composed of an acquisition unit 61, an extraction unit 62, a decoding unit 63, a downmix processing unit 64, and an output unit 65.

The acquisition unit 61 acquires a bit stream from the encoder 11 and supplies the bit stream to the extraction unit 62. The extraction unit 62 extracts dialogue channel information from the bit stream supplied from the acquisition unit 61 and supplies the dialogue channel information to the downmix processing unit 64, and also extracts encoded data from the bit stream and supplies the encoded data to the decoding unit 63.

The decoding unit 63 decodes the encoded data supplied from the extraction unit 62. Further, the decoding unit 63 includes a frequency-to-time conversion unit 71. The frequency-to-time conversion unit 71 performs an inverse modified discrete cosine transform (IMDCT) on the basis of the MDCT coefficient obtained by decoding encoded data by the decoding unit 63. The decoding unit 63 supplies PCM data, which is audio signals obtained by the IMDCT, to the downmix processing unit 64.

The downmix processing unit 64 selects audio signals to be downmixed and audio signal not to be downmixed from the audio signals supplied from the decoding unit 63, on the basis of the dialogue channel information supplied from the extraction unit 62. Further, the downmix processing unit 64 performs a downmixing process on the selected audio signals.

Further, the downmix processing unit 64 obtains conclusive multichannel or monaural channel audio signals by adding the audio signals which are excluded from the target of the downmixing process to the audio signals of the channel which is specified by the dialogue channel information among the audio signals of the predetermined number of channels obtained in the downmixing process. The downmix processing unit 64 supplies the obtained audio signals to the output unit 65.

The output unit 65 outputs the audio signals of each frame supplied from the downmix processing unit 64 to an unillustrated reproducing apparatus or the like in a later stage.

<Configuration Example of Downmix Processing Unit>

Figure 9:
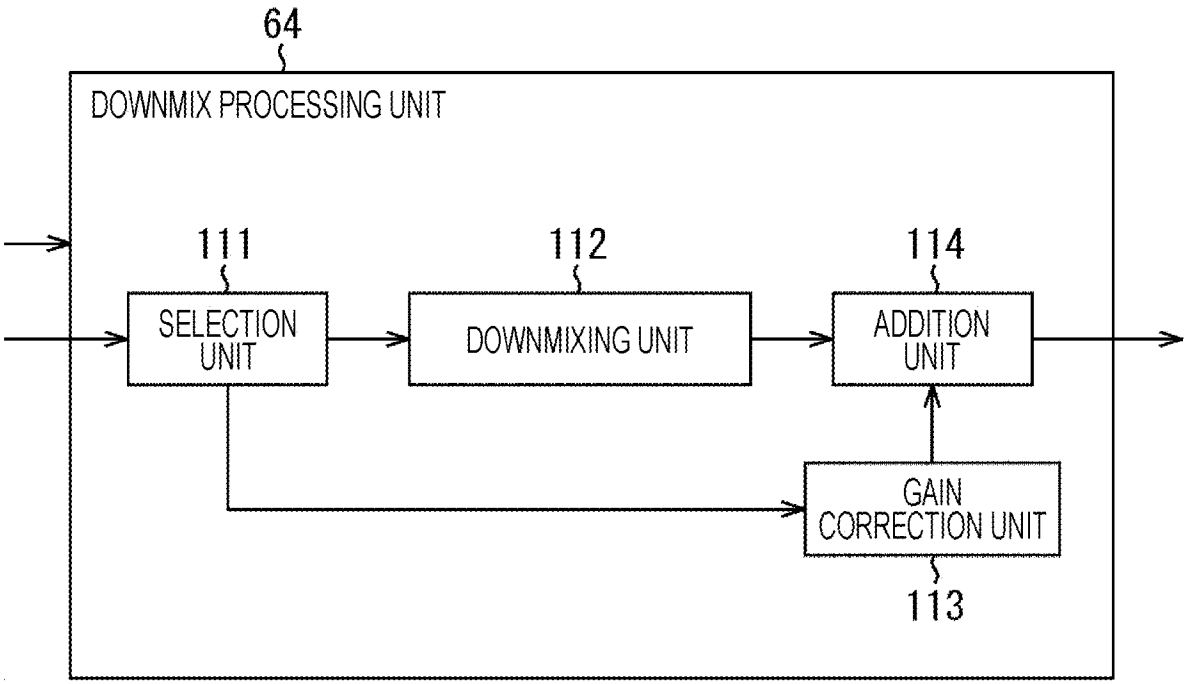
FIG. 9 is a diagram illustrating a configuration example of a downmix processing unit.

Further, the downmix processing unit 64 illustrated in FIG. 8 is configured as illustrated in FIG. 9 for example.

The downmix processing unit 64 illustrated in FIG. 9 includes a selection unit 111, a downmixing unit 112, a gain correction unit 113, and an addition unit 114.

The downmix processing unit 64 reads various information from the dialogue channel information, which is supplied from the extraction unit 62 to the downmix processing unit 64, and supplies the information to each unit in the downmix processing unit 64 according to need.

The selection unit 111 selects audio signals to be downmixed and audio signals not to be downmixed from the audio signals of each channel i supplied from the decoding unit 63, on the basis of diag_present_flag[i], which is the identification information read from the dialogue channel information. In other words, the multichannel audio signals are sorted out into audio signals of dialogue sounds and audio signals with no dialogue sound, and supply destinations of the audio signals are determined according to the sorted results.

More specifically, the selection unit 111 supplies audio signals having diag_present_flag[i] of 1, that is, audio signals of dialogue sounds, to the gain correction unit 113 as signals not to be downmixed. On the other hand, the selection unit 111 supplies audio signals having diag_present_flag[i] of 0, that is, audio signals with no dialogue sound, to the downmixing unit 112 as signals to be downmixed. Here, in more detail, signal values of the audio signals of dialogue sounds are set as "0" and the audio signals of dialogue sounds are also supplied to the downmixing unit 112.

The downmixing unit 112 performs a downmixing process on the audio signals supplied from the selection unit 111, converts the multichannel audio signals input from the selection unit 111 to audio signals in fewer channels, and supplies the signals to the addition unit 114. Here, in the downmixing process, a downmix coefficient read from the bit stream is used according to need.

The gain correction unit 113 performs a gain correction by multiplexing a gain factor defined by diag_mix_gain5 [i][j−1], diag_mix_gain2[i][j−1], or diag_mix_gain1[i] read from the dialogue channel information with the audio signals of dialogue sounds supplied from the selection unit 111 and supplies the gain-corrected audio signals to the addition unit 114.

The addition unit 114 adds the audio signals of dialogue sounds supplied from the gain correction unit 113 to a predetermined channel among the audio signals supplied from the downmixing unit 112 and supplies the audio signals obtained as a result to the output unit 65.

In this case, the destination to add the audio signals of dialogue sounds is specified by diag_dest5[i][j−1] or diag_dest2[i][j−1] read from the dialogue channel information.

Figure 10:
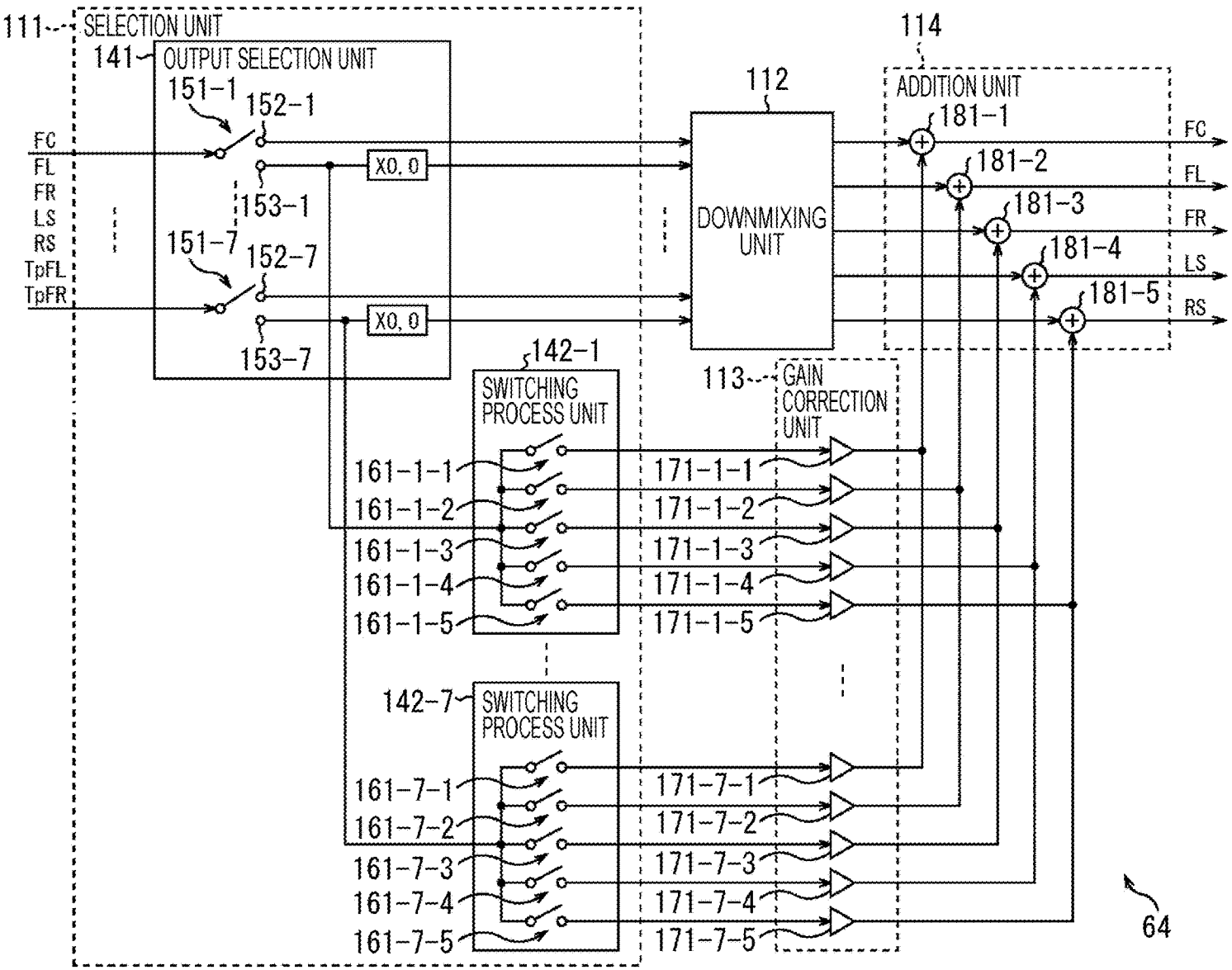
FIG. 10 is a diagram illustrating a more specific configuration example of the downmix processing unit.

Here, when the input to the downmix processing unit 64 is 7.1ch audio signals and the output from the downmix processing unit 64 is 5.1ch audio signals, that is, when downmixing from 7.1ch to 5.1ch is performed, the downmix processing unit 64 is assumed to have a configuration illustrated in FIG. 10 in more detail for example. Here, in FIG. 10, the same numeral references are applied to the parts which correspond to those in the case of FIG. 9 and the explanation thereof will be omitted.

FIG. 10 illustrates a more detailed configuration of each unit of the downmix processing unit 64 illustrated in FIG. 9.

In other words, the selection unit 111 is provided with an output selection unit 141 and switching process units 142-1 to 142-7.

The output selection unit 141 is provided with switches 151-1 to 151-7 and, to the switches 151-1 to 151-7, audio signals of the FC channel, FL channel, FR channel, LS channel, RS channel, TpFL channel, and TpFR channel are supplied from the decoding unit 63.

Here, "0" to "6" of the channel number i are respectively corresponding to the respective channels of FC, FL, FR, LS, RS, TpFL, and TpFR.

The switches 151-I (here, I=1, 2, . . . , and 7) include output terminals 152-I (here, I=1, 2, . . . , and 7) and output terminals 153-I (here, I=1, 2, . . . , and 7) and supplies the audio signal supplied from the decoding unit 63 to one of the output terminals 152-I and 153-I.

More specifically, when the value of diag_present_flag[i], which is identification information, is "0," the switch 151-I (I=i+1) supplies the supplied audio signals to the downmixing unit 112 via the output terminal 152-I.

Further, when the value of diag_present_flag[i] is "1," the switch 151-I outputs the supplied audio signals to the output terminal 153-I. The audio signals output from the output terminal 153-I are brunched into two. One part of the audio signals is simply supplied to the switching process unit 142-I, and the other part of the audio signals is supplied to the downmixing unit 112 after having the values set to "0." With this configuration, the dialogue sound audio signal is not practically supplied to the downmixing unit 112.

Here, the method for setting the audio signal value to "0" may be any method, and, for example, the value of the audio signal is written to "0" or a gain number having a factor of 0 may be multiplied.

Hereinafter, when it is not particularly needed to distinguish the switches 151-1 to 151-7, they are also simply referred to as a switch 151. Similarly, in the following, when it is not particularly needed to distinguish the output terminals 152-1 to 152-7, they are also simply referred to as an output terminal 152 and, when it is not particularly needed to distinguish the output terminals 153-1 to 153-7, they are also simply referred to as an output terminal 153.

The switching process units 142-I (here, I=1, 2, . . . , and 7) include switches 161-I-1 to 161-I-5 (here, I=1, 2, . . . , and 7) of which on and off are controlled by diag_dest5[i][j−1]. The switching process unit 142-I supplies the audio signals supplied from the switch 151-I to multiplication units 171-I-1 to 171-I-5 (here, I=1, 2, . . . , and 7) that composes the gain correction unit 113 via the switches 161-I-1 to 161-I-5 (here, I=1, 2, . . . , and 7) according to need.

More specifically, when diag_dest5[i][j−1] specifies the respective FC, FL, FR, LS, and RS as destination channels to add the audio signals of the channel number i, the respective switches 161-I-1 to 161-I-5 (here, I=i+1) are turned on and the audio signals are supplied to the multiplication units 171-I-1 to 171-I-5 (here, I=i+1).

For example, when the downmixed FC channel is specified by diag_dest5[i][j−1] as a destination channel to add the audio signals of the FC channel having the channel number i=0, the switch 161-I-1 is turned on and the audio signals from the output terminal 153-1 are supplied to the multiplication unit 171-I-1.

Hereinafter, when it is not particularly needed to distinguish the switching process units 142-1 to 142-7, they are also simply referred to as a switching process unit 142.

Also, in the following, when it is not particularly needed to distinguish the switches 161-I-1 to 161-I-5 (here, I=1, 2, . . . , and 7), they are also simply referred to as a switch 161-I and, when it is not particularly needed to distinguish the switches 161-1 to 161-7, they are also simply referred to as a switch 161.

Further, in the following, when it is not particularly needed to distinguish the multiplication units 171-I-1 to 171-I-5 (here, I=1, 2, . . . , and 7), they are also simply referred to as a multiplication unit 171-I and, when it is not particularly needed to distinguish the multiplication units 171-1 to 171-7, they are also simply referred to as a multiplication unit 171.

The gain correction unit 113 includes the multiplication units 171-1-1 to 171-7-5 and, in the multiplication units 171, a gain factor defined by diag_mix_gain5[i][j−1] is set.

More specifically, when diag_dest5[i][j−1] specifies the respective FC, FL, FR, LS, and RS as destination channels to add the audio signals of the channel number i, a gain factor defined by diag_mix_gain5[i][j−1] is set to the multiplication units 171-I-1 to 171-I-5 (here, I=i+1), respectively.

The multiplication units 171-I-1 to 171-I-5 (here, I=1, 2, . . . , and 7) multiply the set gain factor with the audio signals supplied from the switches 161-I-1 to 161-I-5 and supply the signals to adders 181-1 to 181-5 in the addition unit 114. With this configuration, the audio signals of each channel i of dialogue sounds, which are excluded from the target of downmixing, are gain corrected to be supplied to the addition unit 114.

The addition unit 114 includes the adders 181-1 to 181-5 and, to the adders 181-1 to 181-5, downmixed audio signals of the respective FC, FL, FR, LS, and RS channels are supplied from the downmixing unit 112.

The adders 181-1 to 181-5 add the audio signals of dialogue sounds supplied from the multiplication unit 171 to the audio signals supplied from the downmixing unit 112 and supplies to the output unit 65.

Hereinafter, when it is not particularly needed to distinguish the adders 181-1 to 181-5, they are also simply referred to as an adder 181.

<Explanation of Decoding Process>

Next, an operation in the decoder 51 will be explained. Here, in the following, the configuration of the downmix processing unit 64 is the configuration illustrated in FIG. 10 and the explanation will be given on the assumption that the audio signals are downmixed from 7.1ch to 5.1ch.

When a bit stream is transmitted from the encoder 11, the decoder 51 starts a decoding process to receive and decode the bit stream.

Figure 11:
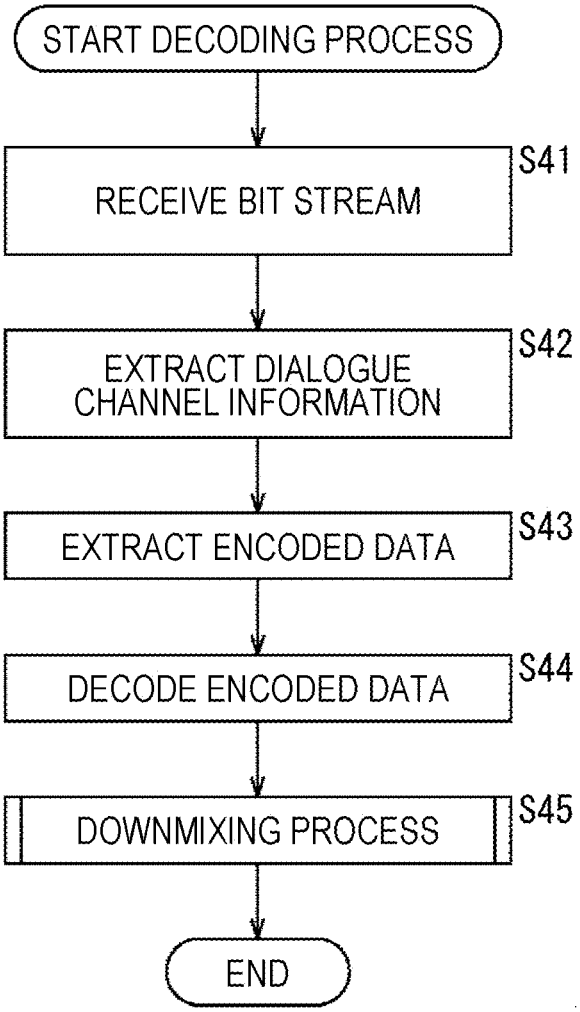
FIG. 11 is a flowchart for explaining a decoding process.

Hereinafter, with reference to a flowchart of FIG. 11, the decoding process executed by the decoder 51 will be explained. The decoding process is performed for each frame of the audio signals.

In step S41, the acquisition unit 61 receives the bit stream transmitted from the encoder 11 and supplies the bit stream to the extraction unit 62.

In step S42, the extraction unit 62 extracts dialogue channel information from DSE of the bit stream supplied from the acquisition unit 61 and supplies the information to the downmix processing unit 64. Further, the extraction unit 62 extracts information such as a downmix coefficient from the DSE according to need and supplies the information to the downmix processing unit 64.

In step S43, the extraction unit 62 extracts encoded data of each channel from the bit stream supplied from the acquisition unit 61 and supplies the data to the decoding unit 63.

In step S44, the decoding unit 63 decodes the encoded data of each channel supplied from the extraction unit 62.

In other words, the decoding unit 63 decodes the encoded data and obtains an MDCT coefficient. More specifically, the decoding unit 63 calculates the MDCT coefficient on the basis of the scale factor, side information, and quantum spectrum supplied as the encoded data. Then, the frequency-to-time conversion unit 71 performs an IMDCT process on the basis of the MDCT coefficient, and supplies the audio signals obtained as a result of the IMDCT process to the switch 151 of the downmix processing unit 64. In other words, a frequency-to-time conversion of the audio signals is performed and audio signals as time signals are obtained.

In step S45, the downmix processing unit 64 performs the downmixing process on the basis of the audio signals supplied from the decoding unit 63 and dialogue channel information supplied from the extraction unit 62 and supplies the audio signals obtained as a result of the downmixing process to the output unit 65. The output unit 65 outputs the audio signal supplied from the downmix processing unit 64 to a reproducing apparatus or the like in a later stage and the decoding process is ended.

Here, although the details of the downmixing process will be described later, in the downmixing process, the audio signals which are not dialogue sound are downmixed, and audio signals of dialogue sounds are added to the downmixed audio signals. Further, the audio signals output from the output unit 65 are supplied to a speaker which is applicable with each channel via a reproducing apparatus or the like, and the sound is reproduced.

As described above, the decoder 51 decodes the encoded data and obtains audio signals while downmixing only audio signals with no dialogue sound using the dialogue channel information and adding the audio signals of dialogue sounds to the downmixed audio signals. This prevents the dialogue sounds from being unclear and a higher quality sound can be obtained.

<Explanation of Downmixing Process>

Figure 12:
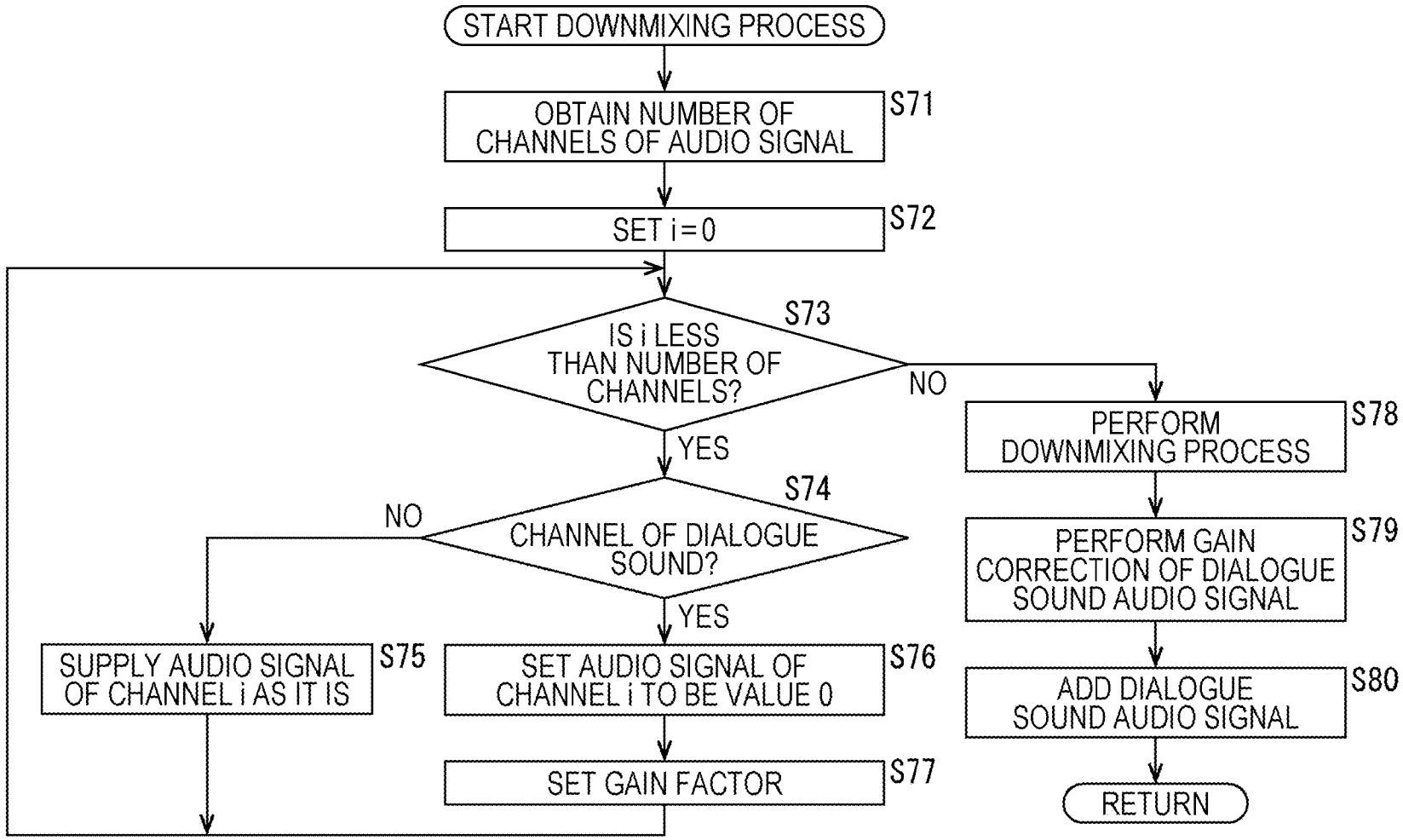
FIG. 12 is a flowchart for explaining a downmixing process.

Next, with reference to a flowchart of FIG. 12, the downmixing process corresponding to step S45 of FIG. 11 will be explained.

In step S71, the downmix processing unit 64 reads get_main_audio_chans( ) from the dialogue channel information supplied from the extraction unit 62 and calculates to obtain a number of channels of the audio signals stored in the bit stream.

Further, the downmix processing unit 64 also reads init_data(chans) from the dialogue channel information and calculates to initialize the value of diag_tag_idx[i] or the like maintained as a parameter. In other words, the value of diag_tag_idx[i] or the like of each channel i is set to "0."

In step S72, the downmix processing unit 64 sets the value of a counter that indicates a channel number of the channel to be processed, that is the value of the channel i indicated by the counter, to i=0. Hereinafter, the counter that indicates the channel number to be processed is also referred to as a counter i.

In step S73, the downmix processing unit 64 determines whether or not the value of the counter i is less than the number of channels obtained in step S71. In other words, it is determined whether or not all the channels have handled as channels to be processed.

In step S73, when it is determined that the value of the counter i is less than the number of the channels, the downmix processing unit 64 reads diag_present_flag[i], which is identification information of the channel i as a processing target, from the dialogue channel information and supplies diag_present_flag[i] to the output selection unit 141, and then the process proceeds to step S74.

In step S74, the output selection unit 141 determines whether or not the channel i to be processed is a channel of a dialogue sound. For example, when the value of diag_present_flag[i] of the channel i to be processed is "1," the output selection unit 141 determines that the channel is a channel of a dialogue sound.

When it is determined that the channel is not a channel of dialogue sound in step S74, the output selection unit 141 controls so that the audio signals of the channel i supplied from the decoding unit 63 are supplied as they are to the downmixing unit 112 in step S75. In other words, the output selection unit 141 controls the switch 151 corresponding to the channel i and connects an input terminal of the switch 151 with the output terminal 152. With this configuration, the audio signals of the channel i are supplied as they are to the downmixing unit 112.

When a destination to supply the audio signals is selected by controlling the switch 151, the downmix processing unit 64 increments the maintained value of the counter i by one. Then, the process returns to step S73 and the above described process is repeated.

On the other hand, when it is determined that the channel is a channel of a dialogue sound in step S74, the output selection unit 141 controls so that the audio signals of the channel i supplied from the decoding unit 63 are supplied as they are to the switching process unit 142 in step S76 and the audio signals supplied from the decoding unit 63 are set as 0 value and supplied to the downmixing unit 112.

In other words, the output selection unit 141 controls the switch 151 corresponding to the channel i and connects the input terminal of the switch 151 with the output terminal 153. Accordingly, the audio signals from the decoding unit 63 are brunched into two after output from the output terminal 153 and a signal value (amplitude) of one part of the audio signals is set to "0" and supplied to the downmixing unit 112. In other words, it is controlled not to practically supply the audio signals to the downmixing unit 112. Further, the other part of the brunched audio signals is supplied as they are to the switching process unit 142 corresponding to the channel i.

In step S77, the downmix processing unit 64 sets a gain factor for the channel i to be processed.

In other words, the downmix processing unit 64 reads diag_dest5[i][j−1] and diag_mix_gain5[i][j−1] of the channel i to be processed from the dialogue channel information as many as the number indicated by num_of_dest_chans5[i] stored in the dialogue channel information.

Then, the selection unit 111 identifies, on the basis of each value of diag_dest5 [i][j−1], a destination to add the audio signals of the channel i to be processed to the downmixed audio signals and controls the operation of the switching process unit 142 according to the identification result.

More specifically, the selection unit 111 controls the switching process unit 142-($i$+1), to which the audio signals of the channel i are supplied, to turn off the switch 161-($i$+1) corresponding to the destination to add the audio signals of the channel i among the five switches 161-($i$+1) and to turn off other switches 161-($i$+1).

By controlling the switching process unit 142 in this manner, the audio signals of the channel i to be processed are supplied to the multiplication unit 171 corresponding to the channel as a destination to add the audio signals.

Further, the downmix processing unit 64 acquires a gain factor of each channel as a destination to add the audio signals of the channel i on the basis of diag_mix_gain5[i][j−1] read from the dialogue channel information and supplies the gain factor to the gain correction unit 113. More specifically, for example, the downmix processing unit 64 acquires a gain factor by calculating a function fac, which is fac[diag_mix_gain5[i][j−1]].

The gain correction unit 113 supplies and sets the gain factor to the multiplication unit 171-($i$+1) corresponding to the destination to add the audio signals of the channel i among the five multiplication units 171-($i$+1).

For example, when it is identified, on the basis of each value of diag_dest5[0][j−1], that the destinations to add the audio signals of the FC channel of which channel i is "0" are channels FC, FL, and FR after downmixing, the switches 161-1-1 to 161-1-3 are turned on and other switches 161-1-4 and 161-1-5 are turned off.

Then, on the basis of diag_mix_gain5[0][j−1], the gain factor of the FC channel before downmixing at a timing of addition to each channel of channels FC, FL, and FR after downmixing is read, and the gain factors are supplied and set to the multiplication units 171-1-1 to 171-1-3. Here, since the audio signals are not supplied to the multiplication units 171-1-4 and 171-1-5, gain factors are not set.

When the switching process unit 142 selects an output destination of the audio signals and sets gain factors in this manner, the downmix processing unit 64 increments the value of the maintained counter i by one. Then, the process returns to step S73 and the above described process is repeated.

Further, when it is determined in step S73 that the value of the counter i is not less than the number of channels obtained in step S71, that is, when all the channels are processed, the downmix processing unit 64 inputs the audio signals supplied from the decoding unit 63 to the switch 151 and the process proceeds to step S78. With this configuration, audio signals which are not a dialogue sound are supplied to the downmixing unit 112 and audio signals of a dialogue sound are supplied to the multiplication unit 171 via the switch 161.

In step S78, the downmixing unit 112 performs a downmixing process on the audio signals of 7.1ch supplied from the switch 151 of the output selection unit 141 and supplies the audio signals of each channel of 5.1ch obtained as a result of the downmixing process to the adder 181. In this case, the downmix processing unit 64 obtains a downmix coefficient by acquiring an index from DSE or the like according to need and supplies the downmix coefficient to the downmixing unit 112 and the downmixing unit 112 preforms downmixing using the supplied downmix coefficient.

In step S79, the gain correction unit 113 performs a gain correction of the audio signals of a dialogue sound supplied from the switch 161 and supplies the signals to the adder 181. In other words, each multiplication unit 171 to which the audio signals are supplied from the switch 161 performs a gain correction by multiplying the set gain factor with the audio signals and supplies the gain-corrected audio signals to the adder 181.

In step S80, the adder 181 adds the audio signals of a dialogue sound supplied from the multiplication unit 171 to the audio signals supplied from the downmixing unit 112 and supplies the signals to the output unit 65. When the audio signals are output from the output unit 65, the downmixing process ends and thereby the decoding process of FIG. 11 also ends.

As described above, the downmix processing unit 64 identifies whether or not the audio signals of each channel are signals of a dialogue sound on the basis of diag_present_flag [i] as identification information, excludes the audio signals of a dialogue sound from the target of the downmixing process, and adds the excluded signals to downmixed audio signals.

With this configuration, a higher quality sound can be obtained. In other words, when audio signals of all channels including the audio signals of a dialogue sound are downmixed, the dialogue sound spreads out in the entire downmixed channels and this makes the dialogue sound unclear as the gain is reduced. On the other hand, with the decoder 51, the dialogue sound does not affected by downmixing and is reproduced in a desired channel, and this makes the dialog sound clearer.

Here, a specific example of the calculation executed in the downmixing process, which has been explained with reference to FIG. 12, will be explained. Here, it is assumed that num_of_dest_chans5 [0]=1, num_of_dest_chans5 [1]=1, diag_dest5 [0][0]=0, and diag_dest5 [1][0]=0.

In other words, it is assumed that the FC channel and FL channel before downmixing are channels of a dialogue sound and the destination to add those dialogue sounds after downmixing is the FC channel.

In this case, the output selection unit 141 obtains a signal as an input of downmixing by calculating the following Expression (1).

[Mathematical Formula 1]

$$FC_dmin=inv(diag_present_flag[0])\times FC$$

$$FL_dmin=inv(diag_present_flag[1])\times FL$$

$$FR_dmin=inv(diag_present_flag[2])\times FR$$

$$LS_dmin=inv(diag_present_flag[3])\times LS$$

$$RS_dmin=inv(diag_present_flag[4])\times RS$$

$$TpFL_dmin=inv(diag_present_flag[5])\times TpFL$$

$$TpFR_dmin=inv(diag_present_flag[6])\times TpFR \quad (1)$$

Here, in Expression (1), FC, FL, FR, LS, RS, TpFL, and TpFR represent values of audio signals of each channel of FC, FL, FR, LS, RS, TpFL, and TpFR supplied from the decoding unit 63. Further, inv( ) is a function that inv(1)=0 and inv(0)=1, that is, a function to invert an input value.

Further, in Expression (1), FC_dmin, FL_dmin, FR_dmin, LS_dmin, RS_dmin, TpFL_dmin, and TpFR_dmin respectively represent audio signals of each channel of FC, FL, FR, LS, RS, TpFL, and TpFR as an input to the downmixing unit 112.

Thus, in the calculation of Expression (1), the audio signals of each channel supplied from the decoding unit 63 are handled as the values as they are or an input to the downmixing unit 112 after being set to "0" according to the value of diag_present_flag[i].

Further, the downmixing unit 112 calculates the following Expression (2) on the basis of FC_dmin, FL_dmin, FR_dmin, LS_dmin, RS_dmin, TpFL_dmin, and TpFR_dmin handled as an input and obtains audio signals of each channel of FC, FL, FR, LS, and RS after downmixing, which are handled as an input to the adder 181.

[Mathematical Formula 2]

$$FC'=FC_d\min$$

$$FL'=FL_d\min\times dmx_f1+TpFL_d\min\times dmx_f2$$

$$FR'=FR_d\min\times dmx_f1+TpFR_d\min\times dmx_f2$$

$$LS'=LS_d\min$$

$$RS'=RS_d\min \quad (2)$$

Here, in Expression (2), FC', FL', FR', LS', and RS' respectively represent audio signals of each channel of FC, FL, FR, LS, and RS, which are handled as inputs to the adders 181-1 to 181-5. Further, dmx_f1 and dmx_f2 represent downmix coefficients.

Further, the multiplication unit 171 and the adder 181 obtain conclusive audio signals of each channel of FC, FL, FR, LS, and RS. In this example, the addition of a dialogue sound is not performed for each channel of FL, FR, LS, and RS, so FL', FR', LS', and RS' are output as they are to the output unit 65.

On the other hand, calculation of the following Expression (3) is performed for FC channel, and FC", which is obtained as a result of the calculation, is output as conclusive audio signals of FC channel.

[Mathematical Formula 3]

$$FC''=FC'+FC\times \mathrm{fac}[\mathrm{diag_mix_gain5}[0][0]]+FL\times \mathrm{fac}[\mathrm{diag_mix_gain5}[1][0]] \quad (3)$$

Here, in Expression (3), FC and FL represent audio signals of FC channel and FL channel supplied to the multiplication unit 171 via the output selection unit 141. Further, fac [diag_mix_gain5[0][0]] represents a gain factor obtained by assigning diag_mix_gain5[0][0] to function fac, and fac [diag_mix_gain5[1][0]] represents a gain factor obtained by assigning diag_mix_gain5[1][0] to function fac.

<Another Configuration Example of Downmix Processing Unit>

Here, in the above, a case that audio signals are downmixed from 7.1ch to 5.1ch has been explained as an example; however, the channel configuration of audio signals before and after downmixing may be any configuration.

Figure 13:
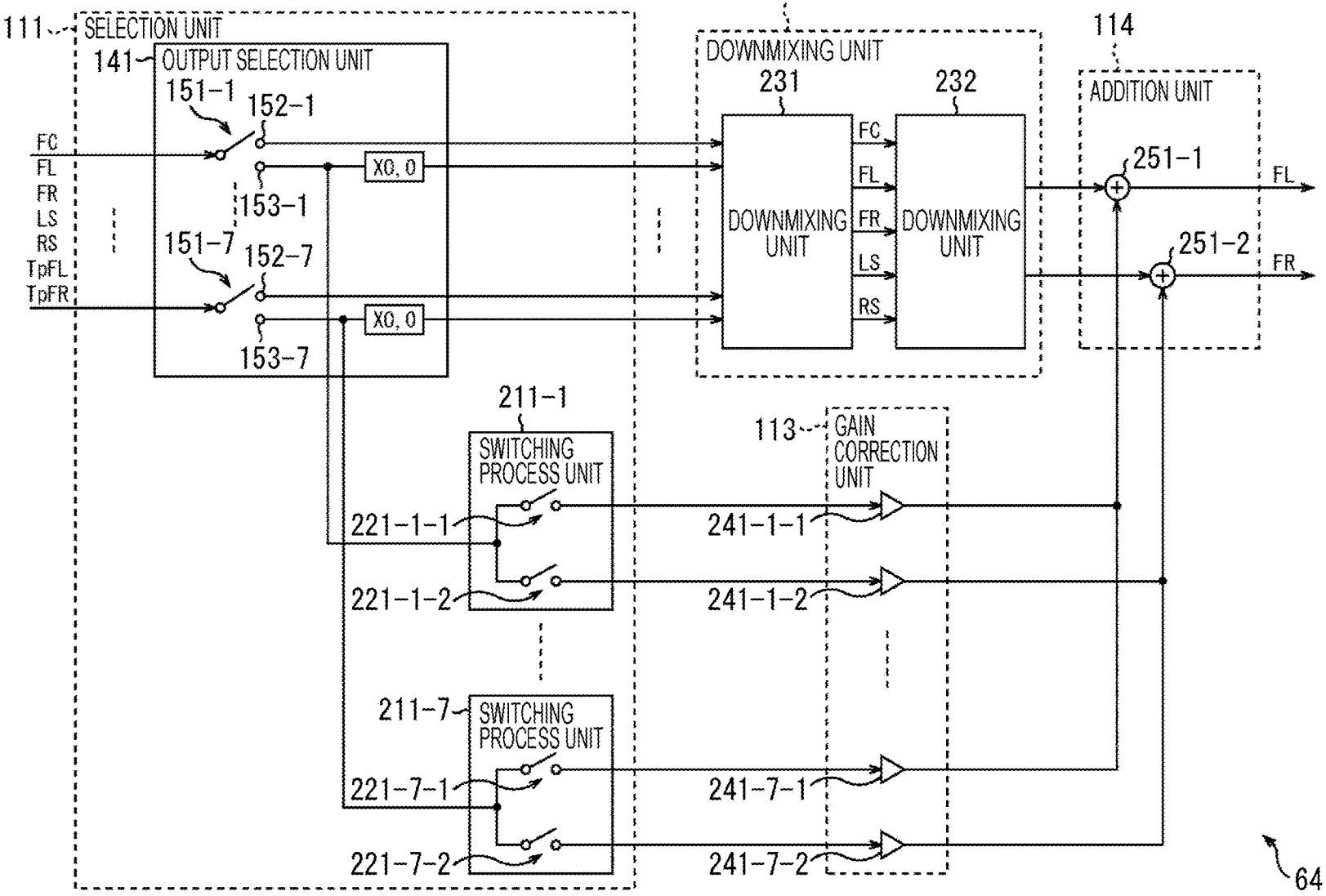
FIG. 13 is a diagram illustrating a more specific configuration example of the downmix processing unit.

For example, when an audio signal is downmixed from 7.1ch to 2ch, the units of the downmix processing unit 64 illustrated in FIG. 9 are arranged as illustrated in FIG. 13 for example. Here, in FIG. 13, the same reference numerals are applied to the parts that correspond to those in FIG. 9 or 10 and the explanation thereof will be omitted.

In the downmix processing unit 64 illustrated in FIG. 13, the selection unit 111 is provided with the output selection unit 141 and switching process units 211-1 to 211-7.

In the output selection unit 141, similarly to the case of FIG. 10, the switches 151-1 to 151-7 are provided and, in the switching process units 211-I (here, I=1, 2, . . . , and 7), switches 221-I-1 and 221-I-2 (here, I=1, 2, . . . , an 7) are provided.

Further, in the downmixing unit 112, a downmixing unit 231 and a downmixing unit 232 are provided and, in the gain correction unit 113, multiplication units 241-I-1 to 241-7-2 are provided. Further, in the addition unit 114, adders 251-1 and 251-2 are provided.

In this example, to the switches 151-1 to 151-7, audio signals of FC channel, FL channel, FR channel, LS channel, RS channel, TpFL channel, and TpFR channel are respectively supplied from the decoding unit 63.

When the value of diag_present_flag[i] as identification information is "0," the switch 151-I (here, I=i+1) supplies the supplied audio signals to the downmixing unit 231 via the output terminal 152-I.

Further, when the value of diag_present_flag[i] is "1," the switch 151-I outputs the supplied audio signals to the output terminal 153-I. The audio signals output from the output terminal 153-I are brunched into two; one part of the audio signals is supplied as they are to the switching process unit 211-I and the other part of the audio signals is supplied to the downmixing unit 231 after having the values set to "0."

The switching process units 211-I (here, I=1, 2, . . . , and 7) supply audio signals supplied from the switch 151-I to the multiplication units 241-I-1 and 241-I-2 (here, I=1, 2, . . . , and 7) composing the gain correction unit 113 via the switches 221-I-1 and 221-I-2 (here, I=1, 2, . . . , and 7) according to need.

More specifically, when diag_dest2[i][j−1] specifies the respective FL and FR as destination channels to add the audio signals of the channel number i, the respective switches 221-I-1 and 221-I-2 (here, I=i+1) are turned on and the audio signals are supplied to the multiplication units 241-I-1 and 241-I-2 (here, I=i+1).

Hereinafter, when it is not particularly needed to distinguish the switching process units 211-1 to 211-7, they are also simply referred to as a switching process unit 211.

Further, in the following, when it is not particularly needed to distinguish the switches 221-I-1 and 221-I-2 (here, I=1, 2, . . . , and 7), they are also simply referred to as a switch 221-I and, when it is not particularly needed to distinguish the switches 221-1 to 221-7, they are also simply referred to as a switch 221.

Further, in the following, when it is not particularly needed to distinguish the multiplication units 241-I-1 and 241-I-2 (here, I=1, 2, . . . , and 7), they are also simply referred to as a multiplication unit 241-I and, when it is not particularly needed to distinguish the multiplication units 241-1 to 241-7, they are also simply referred to as a multiplication unit 241.

In the gain correction unit 113, when diag_dest2[i][j−1] specifies the respective FL and FR as destination channels to add the audio signals of the channel i, a gain factor, which is defined by diag_mix_gain2[i][j−1], is set to the multiplication units 241-I-1 and 241-I-2 (here, I=i+1) respectively.

The multiplication units 241-I-1 and 241-I-2 (here, I=1, 2, . . . , and 7) multiply the set gain factor with the audio signals supplied from the switches 221-I-1 and 221-I-2 and supplies the signals to the adders 251-1 and 251-2 in the addition unit 114. With this configuration, a gain correction is performed on each audio signal of the channel i which is not a target of downmixing and the signals are supplied to the addition unit 114.

The downmixing unit 231 downmixes the audio signals of 7.1ch supplied from the output selection unit 141 to audio signals of 5.1ch and supplies the signals to the downmixing unit 232. The audio signals of 5.1ch output from the downmixing unit 231 are formed of channels of FC, FL, FR, LS, and RS.

The downmixing unit 232 downmixes the audio signals of 5.1ch supplied from the downmixing unit 231 to audio signals of 2ch and supplies the signals to the addition unit 114. The audio signals of 2ch output from the downmixing unit 232 are composed of channels of FL and FR.

To the respective adders 251-1 and 251-2 of the addition unit 114, respective downmixed audio signals of channels of FL and FR are supplied from the downmixing unit 232.

The adders 251-1 and 251-2 add the audio signals of dialogue sound supplied from the multiplication unit 241 to the audio signals supplied from the downmixing unit 232 and supplies to the output unit 65.

Hereinafter, when it is not particularly needed to distinguish the adders 251-1 and 251-2, they are also simply referred to as an adder 251.

The downmix processing unit 64 illustrated in FIG. 13 performs downmixing in multiple stages from 7.1ch to 5.1ch, and then from 5.1ch to 2ch. When downmixing from 7.1ch to 2ch is executed in the downmix processing unit 64 illustrated in FIG. 13 as described above, the following calculation is executed for example.

Here, it is assumed that num_of_dest_chans2[0]=2, num_of_dest_chans2[1]=2, diag_dest2[0][0]=0, diag_dest2[0][1]=1, diag_dest2[1][0]=0, and diag_dest2[1][1]=1.

In other words, it is assumed that the FC channel and FL channel before downmixing are channels of dialogue sounds and the destinations to add those downmixed dialogue sounds are FL channel and FR channel.

In such a case, the output selection unit 141 obtains a signal to input for downmixing by calculating the following Expression (4).

[Mathematical Formula 4]

$$FC_dmin=inv(diag_present_flag[0])\times FC$$

$$FL_dmin=inv(diag_present_flag[1])\times FL$$

$$FR_dmin=inv(diag_present_flag[2])\times FR$$

$$LS_dmin=inv(diag_present_flag[3])\times LS$$

$$RS_dmin=inv(diag_present_flag[4])\times RS$$

$$TpFL_dmin=inv(diag_present_flag[5])\times TpFL$$

$$TpFR_dmin=inv(diag_present_flag[6])\times TpFR \quad (4)$$

In other words, in Expression (4), the calculation similar to the above described Expression (1) is executed.

Further, the downmixing unit 231 calculates the following Expression (5) on the basis of the inputs of FC_dmin, FL_dmin, FR_dmin, LS_dmin, RS_dmin, TpFL_dmin, and TpFR_dmin and obtains downmixed audio signals of channels of FC, FL, FR, LS, and RS as an input to the downmixing unit 232.

[Mathematical Formula 5]

$$FC'=FC_dmin$$

$$FL'=FL_dmin\times dmx_f1+TpFL_dmin\times dmx_f2$$

$$FR'=FR_dmin\times dmx_f1+TpFR_dmin\times dmx_f2$$

$$LS'=LS_dmin$$

$$RS'=RS_dmin \quad (5)$$

In other words, in Expression (5), the calculation similar to the above Expression (2) is executed.

Further, the downmixing unit 232 calculates the following Expression (6) on the basis of the inputs of FC', FL', FR', LS', and RS' and LFE', which is an audio signal of LFE channel, and obtains downmixed audio signals of channels of FL and FR as an input to the addition unit 114.

[Mathematical Formula 6]

$$FL''=FL'+FC'\times dmx_b+LS'\times dmx_a+LFE'\times dmx_c$$

$$FR''=FR'+FC'\times dmx_b+RS'\times dmx_a+LFE'\times dmx_c \quad (6)$$

Here, in Expression (6), FL" and FR" represent audio signals of channels of FL and FR to be input to the adders 251-1 and 251-2. Further, dmx_a, dmx_b, and dmx_c represent downmix coefficients.

Further, the multiplication unit 241 and adder 251 obtain conclusive audio signals of channels of FL and FR. In this example, by calculating the following Expression (7), dialogue sound is added to FL' and FR' and thereby audio signals of FL channel and FR channel are obtained as conclusive outputs of the adder 251.

[Mathematical Formula 7]

$$FL'''=FL''+diag_mix1$$

$$FR'''=FR''+diag_mix2 \quad (7)$$

Here, in Expression (7), FL'" and FR'" represent audio signals of FL channel and FR channel, which are conclusive outputs of the adder 251. Further, it is assumed that diag_mix1 and diag_mix2 are obtained by the following Expression (8).

[Mathematical Formula 8]

$$diag_mix1=FC\times fac[diag_mix_gain2[0][0]]+FL\times fac[diag_mix_gain2[1][0]]$$

$$diag_mix2=FC\times fac[diag_mix_gain2[0][1]]+FL\times fac[diag_mix_gain2[1][1]] \quad (8)$$

Here, in Expression (8), FC and FL represent the audio signals of FC channel and FL channel supplied from the multiplication unit 241 via the output selection unit 141.

Further, fac[diag_mix_gain2[0][0]] represents a gain factor obtained by assigning diag_mix_gain2[0][0] to function fac, and fac[diag_mix_gain2[1][0]] represents a gain factor obtained by assigning diag_mix_gain2[1][0] to function fac. Similarly, fac[diag_mix_gain2[0][1]] represents a gain factor obtained by assigning diag_mix_gain2[0][1] to function fac, and fac [diag_mix_gain2[1][1]] represents a gain factor obtained by assigning diag_mix_gain2[1][1] to function fac.

Further, in the downmix processing unit 64, downmixing from 2ch to 1ch may be executed after downmixing from 7.1ch to 5.1ch is executed and downmixing from 5.1ch to 2ch is further executed. In such a case, for example, the following calculation is executed.

Here, in this case, it is assumed that num_of_dest_chans1[0]=1 and num_of_dest_chans1[1]=1. In other words, it is assumed that FC channel and FL channel before downmixing are channels of dialogue sounds and the destination to add the downmixed dialogue sounds is FC channel.

In such a case, the selection unit 111 obtains signals as an input of downmixing by calculating the following Expression (9).

[Mathematical Formula 9]

$$FC_dmin=inv(diag_present_flag[0])\times FC$$

$$FL_dmin=inv(diag_present_flag[1])\times FL$$

$$FR_dmin=inv(diag_present_flag[2])\times FR$$

$$LS_dmin=inv(diag_present_flag[3])\times LS$$

$$RS_dmin=inv(diag_present_flag[4])\times RS$$

$$TpFL_dmin=inv(diag_present_flag[5])\times TpFL$$

$$TpFR_dmin=inv(diag_present_flag[6])\times TpFR \quad (9)$$

In other words, in Expression (9), the calculation similar to the above described Expression (1) is executed.

Further, the downmixing unit 112 performs downmixing from 7.1ch to 5.1ch by calculating the following Expression (10) on the basis of the inputs of FC_dmin, FL_dmin, FR_dmin, LS_dmin, RS_dmin, TpFL_dmin, and TpFR_dmin.

[Mathematical Formula 10]

$$FC'=FC_dmin$$

$$FL'=FL_dmin\times dmx_f1+TpFL_dmin\times dmx_f2$$

$$FR'=FR_dmin\times dmx_f1+TpFR_dmin\times dmx_f2$$

$$LS'=LS_dmin$$

$$RS'=RS_dmin \quad (10)$$

In other words, in Expression (10), the calculation similar to the above described Expression (2) is executed.

Further, the downmixing unit 112 performs downmixing from 5.1ch to 2ch by calculating the following Expression (11) on the basis of FC', FL', FR', LS', and RS', and LFE', which is an audio signal of LFE channel.

[Mathematical Formula 11]

$$FL''=FL'+FC'\times dmx_b+LS'\times dmx_a+LFE'\times dmx_c$$

$$FR''=FR'+FC'\times dmx_b+RS'\times dmx_a+LFE'\times dmx_c \quad (11)$$

In other words, in Expression (11), the calculation similar to the above described Expression (6) is executed.

In final, the following Expression (12) is calculated by the gain correction unit 113 and addition unit 114, and conclusive audio signals of FC channel are obtained.

[Mathematical Formula 12]

$$FC'''=FL''+FR''+diag_mix \quad (12)$$

Here in Expression (12), FC''' represents conclusive audio channels of FC channel and it is assumed that diag_mix is obtained by the following Expression (13).

[Mathematical Formula 13]

$$diag_mix=FC\times fac[diag_mix_gain1[0]]+FL\times fac[diag_mix_gain1[1]] \quad (13)$$

In Expression (13), FC and FL represent audio signals of FC channel and FL channel supplied from the gain correction unit 113 via the selection unit 111.

Further, fac[diag_mix_gain1[0]] represents a gain factor obtained by assigning diag_mix_gain1[0] to function fac, and fac[diag_mix_gain1[1]] represents a gain factor obtained by assigning diag_mix_gain1[1] to function fac.

Here, in the above description, an example that audio signals of dialogue sounds to be input to downmixing is set to be "0" vale in view of that a channel of a dialogue sound is not used in a downmixing process (not to be downmixed) has been explained; however, the downmix coefficient may be set to be "0." In such a case, the downmix processing unit 64 sets the downmix coefficient of channel i in which the value of diag_present_flag[i] is "1" to "0." With this configuration, the channel of dialogue sound is practically excluded from the downmix process.

Further, since the dialogue channel information includes diag_tag_idx[i] indicating a property of the channel of a dialogue sound, only some of preferable dialogue sounds can be selected and reproduced, by using diag_tag_idx[i], from plural dialogue sounds.

More specifically, when the plural dialogue sounds are used for switching, the selection unit 111 of the downmix processing unit 64 selects one or more channels of dialogue sounds specified by the upper device from the plural channels of dialogue sounds on the basis of diag_tag_idx[i], and supplies the channel to the downmixing unit 112 and gain correction unit 113. In this case, the audio signal of the channel of dialogue sound supplied to the downmixing unit 112 is set to "0" value. Further, regarding other channels of dialogue sounds which are not selected, the selection unit 111 discards audio signals of those channels. With this configuration, switching of languages or the like can be easily performed.

Here, the above described series of processes may be executed by either hardware or software. When the series of processes are executed by software, a program that composes the software is installed in a computer. Here, the computer may be a computer mounted in a dedicated hardware, or a general personal computer capable of executing various functions by installing various programs for example.

Figure 14:
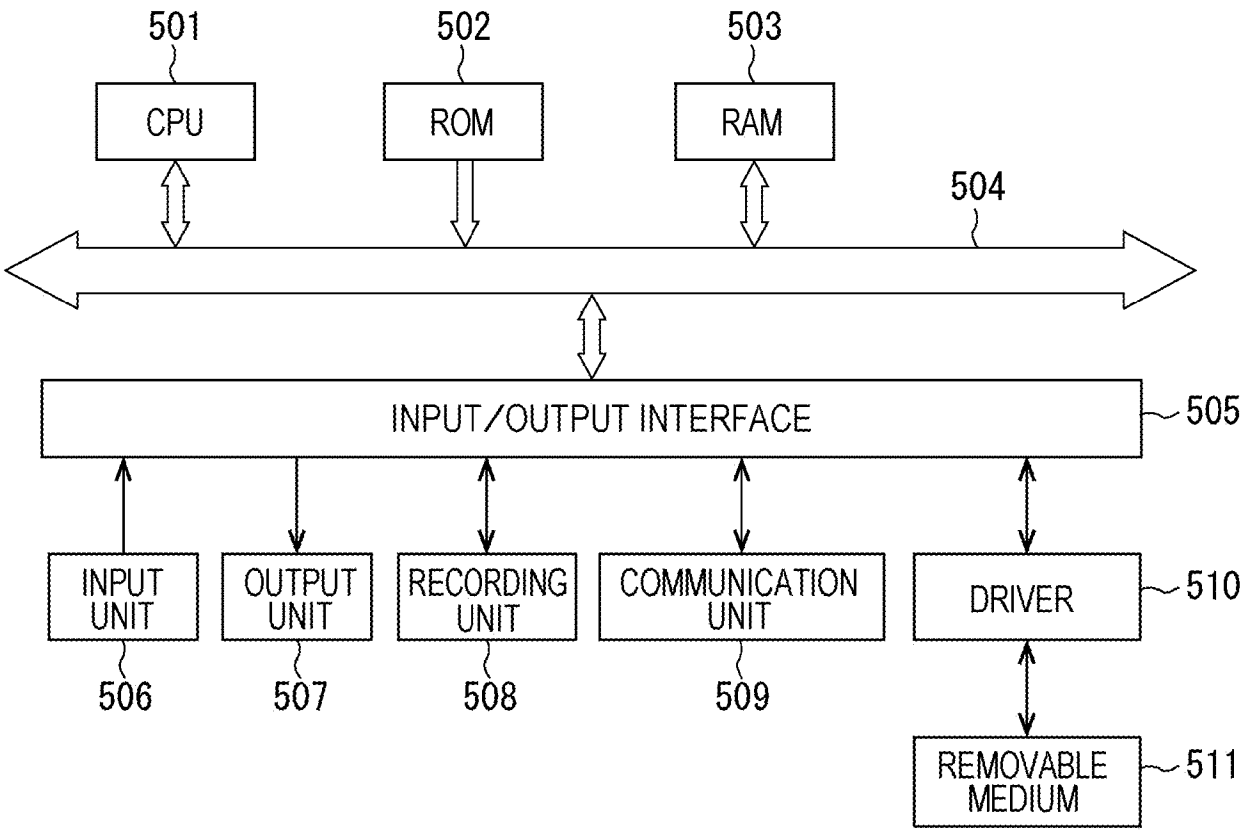
FIG. 14 is a diagram illustrating a configuration example of a computer.

FIG. 14 is a block diagram illustrating a configuration example of hardware of a computer that executes the above described series of processes using a program.

In the computer, a central processing unit (CPU) 501, a read only memory (ROM) 502, and a random access memory (RAM) 503 are connected one another via a bus 504.

To the bus 504, an input/output interface 505 is also connected. To the input/output interface 505, an input unit 506, an output unit 507, a recording unit 508, a communication unit 509, and a driver 510 are connected.

The input unit 506 is composed of a keyboard, a mouse, a microphone, an image capture element, or the like. The output unit 507 is composed of a display, a speaker, or the like. The recording unit 508 is composed of a hard disk, a non-volatile memory, or the like. The communication unit 509 is composed of a network interface or the like. The driver 510 drives a removable medium 511 such as a magnetic disk, an optical disk, a magneto-optical disk, a semiconductor memory, or the like.

In the computer having a configuration described above, for example, the above described series of processes are performed by the CPU 501 by loading and executing a program recorded in the recording unit 508 to the RAM 503 via the input/output interface 505 and bus 504.

The program executed by the computer (CPU 501) can be provided, for example, by recording in the removable medium 511 as a portable medium or the like. Further, the program can be provided via a wired or wireless transmission medium such as a local area network, the Internet, digital satellite broadcasting, or the like.

In the computer, the program can be installed to the recording unit 508 via the input/output interface 505 by attaching the removable medium 511 to the driver 510. Further, the program may be received by the communication unit 509 via a wired or wireless transmission medium and then installed in the recording unit 508. In addition to the above, the program may be installed in the ROM 502 or recording unit 508 in advance.

Here, the program executed by the computer may be a program that executes the processes in chronological order along the order described in this specification or may be a program that the processes are executed in parallel or at a required timing such as the timing a call is performed.

Further, the embodiment of the present technology is not limited to the above described embodiment and various changes can be made within the scope of the present technology.

For example, the present technology may employ a configuration of cloud computing that one function is processed by more than one devices by sharing or working together via a network.

Further, each step explained in the above described flowcharts may be executed by a single device or executed by sharing among more than one devices.

Further, when a plurality of processes are included in one step, the plurality of processes included in the step may be executed by a single device or executed by sharing among more than one devices.

Further, the present technology may employ the following configurations.

(1)

An audio signal processing device including:

a selection unit configured to select, from multichannel audio signals, audio signals of a channel of a dialogue sound and audio signals of plural channels to be downmixed, on the basis of information related to each channel of the multichannel audio signals;

a downmixing unit configured to downmix the audio signals of the plural channels to be downmixed into audio signals of one or more channels; and an addition unit configured to add the audio signals of the channel of a dialogue sound to audio channels of a predetermined channel among the one or more channels obtained by the downmixing.

(2)

The audio signal processing device according to (1), wherein the addition unit adds the audio signals of the channel of a dialogue sound to the predetermined channel that is a channel specified by addition destination information indicating a destination to add the audio signals of the channel of a dialogue sound.

(3)

The audio signal processing device according to (2), further including a gain correction unit configured to perform a gain correction of the audio sounds of the channel of a dialogue sound on the basis of gain information indicating a gain of the audio signals of the channel of a dialogue sound at a timing of addition to the audio signals of the predetermined channel, wherein the addition unit adds the audio signals in which the gain is corrected by the gain correction unit to the audio signals of the predetermined channel.

(4)

The audio signal processing device according to (3), further including an extraction unit configured to extract the information related to each channel, the addition destination information, and the gain information from a bit stream.

(5)

The audio signal processing device according to (4), wherein the extraction unit further extracts the encoded multichannel audio signals from the bit stream, and the audio signal processing device further includes a decoding unit configured to decode the encoded multichannel audio signals and output to the selection unit.

(6)

The audio signal processing device according to any one of (1) to (5), wherein the downmixing unit performs multiple-stage downmixing on the audio signals of the plural channels to be downmixed, and the addition unit adds the audio signals of the channel of a dialogue sound to the audio signals of the predetermined channel among the audio signals of the one or more channels obtained in the multiple-stage downmixing.

(7)

An audio signal processing method including the steps of:

selecting, from multichannel audio signals, audio signals of a channel of a dialogue sound and audio signals of plural channels to be downmixed, on the basis of information related to each channel of the multichannel audio signals;

downmixing the audio signals of the plural channels to be downmixed into audio signals of one or more channels; and adding the audio signals of the channel of a dialogue sound to audio signals of a predetermined channel among the audio signals of the one or more channels obtained in the downmixing.

(8)

A program that causes a computer to execute the steps including:

selecting, from multichannel audio signals, audio signals of a channel of a dialogue sound and audio signals of plural channels to be downmixed, on the basis of information related to each channel of the multichannel audio signals;

downmixing the audio signals of the plural channels to be downmixed into audio signals of one or more channels; and adding the audio signals of the channel of a dialogue sound to the audio signals of a predetermined channel among the audio signals of the one or more channels obtained in the downmixing.

(9)

An encoding device including:

an encoding unit configured to encode multichannel audio signals;

a generation unit configured to generate identification information, which indicates whether or not each channel of the multichannel audio signals is a channel of a dialogue sound; and a packing unit configured to generate a bit stream including the encoded multichannel audio signals and the identification information.

(10)

The encoding device according to (9), wherein when the multichannel audio signals are downmixed, the generation unit further generates addition destination information, which indicates a channel of audio signals as a destination to add the audio signals of the channel of a dialogue sound among audio signals of one or more channels obtained by downmixing, and the packing unit generates the bit stream including the encoded multichannel audio signals, the identification information, and the addition destination information.

(11)

The encoding device according to (10), wherein the generation unit further generates gain information of the audio signals of the channel of a dialogue sound at a timing of addition to a channel indicated by the addition destination information, and the packing unit generates the bit stream including the encoded multichannel audio signals, the identification information, the addition destination information, and the gain information.

(12)

An encoding method including the steps of:

encoding multichannel audio signals;

generating identification information, which indicates whether or not each channel of the multichannel audio signals is a channel of a dialogue sound, and generating a bit stream including the encoded multichannel audio signals and the identification information.

(13)

A program that causes a computer to execute a process including the steps including:

encoding multichannel audio signals;

generating identification information, which indicates whether or not each channel of the multichannel audio signals is a channel of a dialogue sound; and generating a bit stream including the encoded multichannel audio signals and the identification information.

REFERENCE SIGNS LIST

11 Encoder
21 Dialogue channel information generation unit
22 Encoding unit
23 Packing unit
51 Decoder
63 Decoding unit
64 Downmix processing unit
111 Selection unit
112 Downmixing unit
113 Gain correction unit
114 Addition unit

The invention claimed is:

1. An audio signal processing device comprising:

a processing device and a memory device containing instructions that, when executed by the processing device, implement:

a selection unit configured to select, from multichannel audio signals representative of a reproduction environment, audio signals of a dialogue channel not to be downmixed and audio signals of plural channels to be downmixed, on the basis of information related to each channel of the multichannel audio signals;

a downmixing unit configured to downmix the audio signals of the plural channels to be downmixed into audio signals of one or more channels and to not downmix the dialogue channel; and an addition unit configured to add the audio signals of the dialogue channel to audio channels of a predetermined channel among the one or more channels obtained by the downmixing, wherein the dialogue channel is supplied by the selection unit to the addition unit and is not supplied by the selection unit to the downmixing unit.

2. The audio signal processing device according to claim 1, wherein the addition unit adds the audio signals of the dialogue channel to the predetermined channel that is a channel specified by addition destination information indicating a destination to add the audio signals of the dialogue channel.

3. The audio signal processing device according to claim 2, wherein the instructions further implement:

a gain correction unit configured to perform a gain correction of the audio sounds of the dialogue channel on the basis of gain information indicating a gain of the audio signals of the dialogue channel at a timing of addition to the audio signals of the predetermined channel, wherein the addition unit adds the audio signals in which the gain is corrected by the gain correction unit to the audio signals of the predetermined channel.

4. The audio signal processing device according to claim 3, wherein the instructions further implement:

an extraction unit configured to extract the information related to each channel, the addition destination information, and the gain information from a bit stream.

5. The audio signal processing device according to claim 4, wherein the extraction unit further extracts the encoded multichannel audio signals from the bit stream, and the audio signal processing device further comprises a decoding unit configured to decode the encoded multichannel audio signals and output to the selection unit.

6. The audio signal processing device according to claim 1, wherein the downmixing unit performs multiple-stage downmixing on the audio signals of the plural channels to be downmixed, and the addition unit adds the audio signals of the dialogue channel to the audio signals of the predetermined channel among the audio signals of the one or more channels obtained in the multiple-stage downmixing.

7. An audio signal processing method comprising:

selecting, by a selection unit, from multichannel audio signals representative of a reproduction environment, audio signals of a dialogue channel not to be downmixed and audio signals of plural channels to be downmixed, on the basis of information related to each channel of the multichannel audio signals;

downmixing, by a downmixing unit, the audio signals of the plural channels to be downmixed into audio signals of one or more channels and not downmixing the dialogue channel; and adding, by an addition unit, the audio signals of the dialogue channel to audio signals of a predetermined channel among the audio signals of the one or more channels obtained in the downmixing, wherein the dialogue channel is supplied by the selection unit to the addition unit and is not supplied by the selection unit to the downmixing unit.

8. A non-transitory computer-readable medium containing instructions that, when executed by a processing device, perform an audio signal processing method comprising:

selecting, by a selection unit, from multichannel audio signals representative of a reproduction environment, audio signals of a dialogue channel not to be downmixed and audio signals of plural channels to be downmixed, on the basis of information related to each channel of the multichannel audio signals;

downmixing, by a downmixing unit, the audio signals of the plural channels to be downmixed into audio signals of one or more channels and not downmixing the dialogue channel; and adding, by an addition unit, the audio signals of the dialogue channel to the audio signals of a predetermined channel among the audio signals of the one or more channels obtained in the downmixing, wherein the dialogue channel is supplied by the selection unit to the addition unit and is not supplied by the selection unit to the downmixing unit.

* * * * *